US010526686B2

(12) United States Patent
Aono et al.

(10) Patent No.: US 10,526,686 B2
(45) Date of Patent: Jan. 7, 2020

(54) LOW-OXYGEN CLEAN STEEL AND LOW-OXYGEN CLEAN STEEL PRODUCT

(71) Applicant: NIPPON STEEL & SUMITOMO METAL CORPORATION, Tokyo (JP)

(72) Inventors: Michimasa Aono, Hokkaido (JP); Kenichiro Miyamoto, Kitakyushu (JP); Masanobu Suzuki, Hokkaido (JP)

(73) Assignee: NIPPON STEEL CORPORATION, Tokyo (JP)

( * ) Notice: Subject to any disclaimer, the term of this patent is extended or adjusted under 35 U.S.C. 154(b) by 538 days.

(21) Appl. No.: 14/783,698

(22) PCT Filed: Apr. 24, 2014

(86) PCT No.: PCT/JP2014/061551
§ 371 (c)(1),
(2) Date: Oct. 9, 2015

(87) PCT Pub. No.: WO2014/175377
PCT Pub. Date: Oct. 30, 2014

(65) Prior Publication Data

US 2016/0053352 A1 Feb. 25, 2016

(30) Foreign Application Priority Data

Apr. 24, 2013 (JP) ..... 2013-091725

(51) Int. Cl.
*C22C 38/38* (2006.01)
*C22C 38/00* (2006.01)
(Continued)

(52) U.S. Cl.
CPC ..... *C22C 38/38* (2013.01); *C22C 38/00* (2013.01); *C22C 38/002* (2013.01);
(Continued)

(58) Field of Classification Search
CPC ..... C22C 30/04
See application file for complete search history.

(56) References Cited

U.S. PATENT DOCUMENTS 6,120,578 A * 9/2000 Nakato ..... C21C 7/06 75/568
6,511,553 B1 * 1/2003 Nakashima ..... C21C 7/0006 148/320
(Continued)

FOREIGN PATENT DOCUMENTS

CN 1076969 A 10/1993
CN 101403070 A 4/2009
(Continued)

OTHER PUBLICATIONS

English translation of the Japanese Office Action dated Jan. 5, 2016 for counterpart Application No. 2015-513829.
(Continued)

*Primary Examiner* — Christopher S Kessler
*Assistant Examiner* — Michael J Kachmarik
(74) *Attorney, Agent, or Firm* — Birch, Stewart, Kolasch & Birch, LLP

(57) ABSTRACT

Low-oxygen clean steel is provided containing C, Si, Mn, P, and S as chemical components, and further containing, by mass %, 0.005% to 0.20% of Al, greater than 0% to 0.0005% of Ca, 0.00005% to 0.0004% of REM, and greater than 0% to 0.003% of T.O, wherein the REM content, the Ca content, and the T.O content satisfy 0.15≤REM/Ca≤4.00 and Ca/T.O≤0.50, nonmetallic inclusions which have a maximum predicted diameter of 1 μm to 30 μm measured using an extreme value statistical method under the condition in which a prediction area is 30,000 $mm^2$, and contain $Al_2O_3$ and REM oxide are dispersed in the steel, an average proportion of the $Al_2O_3$ in the nonmetallic inclusions is greater than 50%, the REM is one or two or more of
(Continued)

rare-earth elements La, Ce, Pr, and Nd, and the steel is Al-deoxidized steel or Al—Si-deoxidized steel.

14 Claims, 7 Drawing Sheets

(51) Int. Cl.

| | |
|---|---|
| ***C22C 38/06*** | (2006.01) |
| ***C22C 38/60*** | (2006.01) |
| ***C22C 38/02*** | (2006.01) |
| ***C22C 38/22*** | (2006.01) |
| ***C22C 38/34*** | (2006.01) |
| ***C22C 38/08*** | (2006.01) |
| ***C21C 7/04*** | (2006.01) |
| ***C21C 7/06*** | (2006.01) |
| ***C22C 38/04*** | (2006.01) |

(52) U.S. Cl.
CPC ..... *C22C 38/005* (2013.01); *C22C 38/02* (2013.01); *C22C 38/04* (2013.01); *C22C 38/06* (2013.01); *C22C 38/08* (2013.01); *C22C 38/22* (2013.01); *C22C 38/34* (2013.01); *C22C 38/60* (2013.01); *C21C 7/04* (2013.01); *C21C 7/06* (2013.01)

(56) References Cited

U.S. PATENT DOCUMENTS

| | | | | |
|---|---|---|---|---|
| 7,429,301 | B2 * | 9/2008 | Sugimura | C22C 38/002 148/320 |
| 2003/0138343 | A1 * | 7/2003 | Matsui | C21C 7/06 420/126 |
| 2006/0156864 | A1 * | 7/2006 | Sakamoto | C01B 33/06 75/570 |
| 2006/0260719 | A1 * | 11/2006 | Mizoguchi | C21C 7/0006 148/331 |
| 2010/0084057 | A1 * | 4/2010 | Furuhashi | C22C 38/04 148/603 |
| 2013/0142688 | A1 * | 6/2013 | Yamamoto | C22C 38/001 420/83 |

FOREIGN PATENT DOCUMENTS

| | | | |
|---|---|---|---|
| CN | 101845590 | A | 9/2010 |
| EP | 1312689 | A1 | 5/2003 |
| JP | 63-140068 | A | 6/1988 |
| JP | 9-263820 | A | 10/1997 |
| JP | 2000-8138 | A | 1/2000 |
| JP | 2000-119803 | A | 4/2000 |
| JP | 2000-313941 | A | 11/2000 |
| JP | 2004-52076 | A | 2/2004 |
| JP | 2004-52077 | A | 2/2004 |
| JP | 2005-2419 | A | 1/2005 |
| JP | 2005-2420 | A | 1/2005 |
| JP | 2005-2421 | A | 1/2005 |
| JP | 2005-2422 | A | 1/2005 |
| JP | 2005-2425 | A | 1/2005 |
| JP | 2005-29888 | A | 2/2005 |
| JP | 2005-60739 | A | 3/2005 |
| JP | 2006-97110 | A | 4/2006 |
| JP | 2007-63589 | A | 3/2007 |
| JP | 2007-186744 | A | 7/2007 |
| JP | 2012-46789 | A | 3/2012 |
| JP | 2012-188745 | A | 10/2012 |

OTHER PUBLICATIONS

International Search Report, issued in PCT/JP2014/061551, dated Jul. 29, 2014.
Written Opinion of the International Searching Authority, issued in PCT/JP2014/061551, dated Jul. 29, 2014.
Chinese Office Action and Chinese Search Report, dated Jun. 7, 2016, for Chinese Application No. 201480022840.6, along with an English translation of the Chinese Search Report.
Korean Notice of Allowance, dated Dec. 28, 2016, for corresponding Korean Application No. 10-2015-7030283, along with an English translation.
Extended European Search Report for European Application No. 14787606.4, dated Nov. 2, 2016.
Indian Office Action for Indian Application No. 9627/DELNP/2015, dated Jun. 19, 2019, with an English translation.

* cited by examiner

LOW-OXYGEN CLEAN STEEL AND LOW-OXYGEN CLEAN STEEL PRODUCT

TECHNICAL FIELD OF THE INVENTION

The present invention relates to low-oxygen clean steel and a steel product produced from the low-oxygen clean steel, and particularly, to low-oxygen clean steel obtained by casting low-oxygen clean molten steel deoxidized with Al or Al—Si, and a low-oxygen clean steel product produced from the low-oxygen clean steel.

Priority is claimed on Japanese Patent Application No. 2013-091725, filed Apr. 24, 2013, the content of which is incorporated herein by reference.

RELATED ART

Conventionally, steel having excellent mechanical characteristics has been required as a steel for a steel rod or a wire rod. Usually, in steel available for these uses, breakage and fatigue breakage resulting from nonmetallic inclusions easily occur with an increase in strength. The nonmetallic inclusions are mainly $Al_2O_3$-containing inclusions generated in the course of deoxidation.

As for the $Al_2O_3$-containing inclusions, particles of the $Al_2O_3$-based inclusions form clusters, or components such as CaO are incorporated, and thus the melting point of the inclusion particles is lowered. Therefore, the particles aggregate together and easily increase in size. The inclusions having a size increased due to the aggregation cause deterioration in performance of a steel. Accordingly, various methods of preventing the increase in size of the inclusions have been examined. Many methods of decreasing the size of inclusions by suppressing the formation of clusters due to the aggregation of inclusion particles have been proposed.

For example, Patent Documents 1 to 6 disclose a method of reducing FeO binders of alumina clusters by adding a minute amount of REM to a steel. This method is effective in reducing the FeO binders, however, the generation of coarse CaO—$Al_2O_3$-based inclusions caused by a minute amount of Ca or CaO inevitably mixed in the steel cannot be prevented only by adding REM.

Patent Document 7 discloses a method of reducing FeO binders of alumina clusters by adding Mg. However, in this method, similarly to the method disclosed in Patent Documents 1 to 6, coarse CaO—$Al_2O_3$—MgO-based inclusions are generated by a minute amount of Ca or CaO and a minute amount of Mg or MgO which are inevitably mixed in from a refractory material for refining.

Patent Document 8 discloses a method of preventing the generation of coarse inclusions by further deoxidation of steel, in which "O" (dissolved oxygen) in the steel is controlled and removed with Al, in order of Ti and REM. However, in this method, since "O" is intentionally allowed to remain in the steel, an increase in the degree of oxidation of slag cannot be avoided in a secondary refining process, and thus this method is not applied to the production of low-oxygen clean steel.

Patent Document 9 discloses a method of preventing the generation of cluster-like inclusions which cause press cracks by complex deoxidation with Al+Ti+REM. However, in the method described in Patent Document 9, deoxidation with Ti is essentially similar to the method described in Patent Document 8, and thus the method described in Patent Document 9 cannot be applied to the production of low-Ti steel. In addition, the method described in Patent Document 9 cannot be applied to the production of high-cleanliness steel since it is difficult to intentionally form inclusions having 50% or greater of $Al_2O_3$ under strong-deoxidation refining.

Patent Document 10 discloses a steel which contains $SiO_2$-based stretching inclusions and in which REM is added as a deoxidizing agent to decrease T.O (total oxygen in the steel). However, in steel including steel for a suspension spring and a bearing, Al is essentially added to provide fine crystal grains. Therefore, the base of the composition of the inclusions changes from $SiO_2$ to $Al_2O_3$ due to the deoxidation with Al. Accordingly, the technology described in Patent Document 10 cannot be applied to Al-added steel.

Patent Document 11 discloses a method of improving, when REM-containing molten steel is cast, producibility upon casting by adding REM in accordance with "O" and "S" in the molten steel. However, this method is a method for preventing the generation of REM sulfide when the REM is added, and its object is not the modification of inclusions. Accordingly, the target value of REM is significantly high.

Patent Document 12 discloses high-cleanliness steel having excellent fatigue properties and cold workability. However, the characteristics of Patent Document 12 relate to the adjustment of the composition of oxide-based inclusions in Si-deoxidized steel, and do not relate to the modification of $Al_2O_3$-based inclusions by the addition of REM.

PATENT DOCUMENT

[Patent Document 1] Japanese Unexamined Patent Application, First Publication No. 2004-052076

[Patent Document 2] Japanese Unexamined Patent Application, First Publication No. 2004-052077

[Patent Document 3] Japanese Unexamined Patent Application, First Publication No. 2005-002420

[Patent Document 4] Japanese Unexamined Patent Application, First Publication No. 2005-002421

[Patent Document 5] Japanese Unexamined Patent Application, First Publication No. 2005-002422

[Patent Document 6] Japanese Unexamined Patent Application, First Publication No. 2005-002425

[Patent Document 7] Japanese Unexamined Patent Application, First Publication No. 2005-002419

[Patent Document 8] Japanese Unexamined Patent Application, First Publication No. 2007-186744

[Patent Document 9] Japanese Unexamined Patent Application, First Publication No. 2006-097110

[Patent Document 10] Japanese Unexamined Patent Application, First Publication No. S63-140068

[Patent Document 11] Japanese Unexamined Patent Application, First Publication No. 2005-060739

[Patent Document 12] Japanese Unexamined Patent Application, First Publication No. 2005-029888

DISCLOSURE OF THE INVENTION PROBLEMS TO BE SOLVED BY THE INVENTION

As described above, conventionally, various methods of improving mechanical characteristics of a steel for a steel rod or a wire rod have been proposed. However, basically, all these methods are methods of suppressing the generation of inclusions or decreasing the size of inclusions.

In recent years, a steel for a steel rod or a wire rod has been required to be further improved in mechanical characteristics. In order to meet such a requirement, it is necessary to examine improvement measures based on a viewpoint different from that of conventional methods.

In order to improve mechanical characteristics, particularly, fatigue properties of a steel for a steel rod or a wire rod, the inventors of the invention have conducted intensive studies focusing on "the modification of inclusions", which has not been considered in conventional methods.

The invention is contrived in view of the above-described circumstances. An object of the invention is to improve mechanical characteristics by suppressing the generation of inclusions and by modifying the inclusions. Specifically, the object is to improve mechanical characteristics, particularly, fatigue properties by suppressing the generation of CaO—$Al_2O_3$-based inclusions which easily aggregate together and increase in size in Al-deoxidized steel and Al—Si-deoxidized steel containing $Al_2O_3$ inclusions, by modifying the inclusions, and by controlling the form of the inclusions. In addition, an object of the invention is to provide steel in which the above-described problem has been solved, and a steel product formed of the steel.

Means for Solving the Problem

The inventors of the invention have thought that in order to suppress the generation and coarsening of CaO—$Al_2O_3$-based inclusions which easily increase in size, it is effective to previously decrease the amount of CaO—$Al_2O_3$-based inclusions to be generated by suppressing the mixing of Ca or a Ca-containing material in molten steel, and it is also effective to modify residual CaO—$Al_2O_3$-based inclusions into inclusions having another component composition by adding some inclusion modifying materials. The inventors of the invention have analyzed changes in properties of the inclusions and in characteristics of the steel by adding various substances as an inclusion modifying material. As a result, they have obtained the following knowledge.

That is, it has been found that the inclusions can be modified by adding, to molten steel in which T.O (total oxygen) has been sufficiently decreased by performing Al deoxidation or Al—Si deoxidation while suppressing the mixing of Ca or a Ca-containing material in the molten steel, a minute amount of REM (rare-earth elements) such as La, Ce, Pr, and Nd before the end of the deoxidation.

Here, T.O is a total amount of the dissolved oxygen in the steel and the undissolved oxygen contained in the inclusions etc.

Specifically, the generation of CaO—$Al_2O_3$-based inclusions is suppressed by adding REM as described above. Furthermore, it has been found that CaO of the CaO—$Al_2O_3$-based inclusions generated in a small amount is reduced by REM, and thus the CaO—$Al_2O_3$ inclusions are modified into $Al_2O_3$-based and/or $REM_2O_3$-based inclusions or composite inclusions including these inclusions.

The invention is based on the above-described knowledge and the gist thereof is as follows.

(1) According to an aspect of the invention, there is provided low-oxygen clean steel containing C, Si, Mn, P, and S as chemical components, and further containing, by mass %, 0.005% to 0.20% of Al, greater than 0% to 0.0005% of Ca, 0.00005% to 0.0004% of REM, and greater than 0% to 0.003% of T.O, wherein the REM content, the Ca content, and the T.O content satisfy the following Expressions 1 and 2, nonmetallic inclusions which have a maximum predicted diameter of 1 μm to 30 μm measured using an extreme value statistical method under the condition in which a prediction area is 30,000 $mm^2$, and contain $Al_2O_3$ and REM oxide are dispersed in the steel, an average proportion of the $Al_2O_3$ in the nonmetallic inclusions is greater than 50%, the REM is one or two or more of rare-earth elements La, Ce, Pr, and Nd, and the steel is Al-deoxidized steel or Al—Si-deoxidized steel.

$$0.15 \leq REM/Ca \leq 4.00 \quad \text{Expression 1}$$

$$Ca/T.O \leq 0.50 \quad \text{Expression 2}$$

(2) The low-oxygen clean steel according to (1) may further satisfy the following Expression 3.

$$0.05 \leq REM/T.O \leq 0.50 \quad \text{Expression 3}$$

(3) The low-oxygen clean steel according to (1) or (2) may contain, by mass %, 1.20% or less of C, 3.00% or less of Si, 16.0% or less of Mn, 0.05% or less of P, and 0.05% or less of S as the chemical components with the remainder Fe and impurities.

(4) The low-oxygen clean steel according to (3) may further contain, by mass %, one or two or more of 3.50% or less of Cr, 0.85% or less of Mo, 4.50% or less of Ni, 0.20% or less of Nb, 0.45% or less of V, 0.30% or less of W, 0.006% or less of B, 0.06% or less of N, 0.25% or less of Ti, 0.50% or less of Cu, 0.45% or less of Pb, 0.20% or less of Bi, 0.01% or less of Te, 0.20% or less of Sb, and 0.01% or less of Mg as the chemical components.

(5) According to another aspect of the invention, there is provided a low-oxygen clean steel product produced by processing the low-oxygen clean steel according to (1) or (2).

(6) According to still another aspect of the invention, there is provided a low-oxygen clean steel product produced by processing the low-oxygen clean steel according to (3).

(7) According to still another aspect of the invention, there is provided a low-oxygen clean steel product produced by processing the low-oxygen clean steel according to (4).

Effects of the Invention

According to the above-described aspect of the invention, it is possible to provide low-oxygen clean steel which has excellent fatigue properties and in which nonmetallic inclusions containing $Al_2O_3$ and REM oxide which have a high melting point and hardly aggregate are dispersed in the steel. The nonmetallic inclusions may contain REM sulfide, MgO, or both of REM sulfide and MgO.

BRIEF DESCRIPTION OF DRAWINGS

FIGS. 6(*a*) and 6(*b*) show forms of nonmetallic inclusions of invention examples ("No. 2-1" in Tables 2-1 and 2-2 to be shown later), and FIGS. 6(*c*) and 6(*d*) show forms of nonmetallic inclusions of comparative examples ("No. 2-2" in Tables 2-1 and 2-2 to be shown later).

FIG. 7(*a*) shows a shape of the material of the radial rolling fatigue test piece, FIG. 7(*b*) shows an aspect of the collection of the radial rolling fatigue test piece, and FIG. 7(*c*) shows a final shape of the collected radial rolling fatigue test piece.

DESCRIPTION OF EMBODIMENTS

Figure 1:
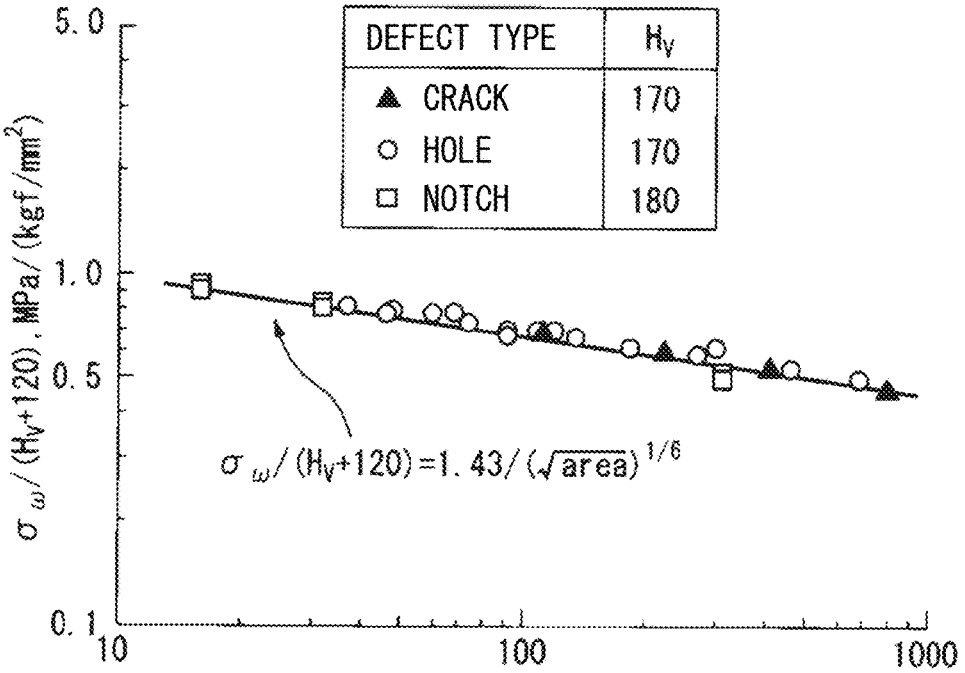
FIG. 1 is a diagram showing the relationship between a maximum grain diameter (√area (μm)) of nonmetallic inclusions and fatigue strength (MPa) (Non-Patent Document Yukitaka Murakami, "Metal Fatigue, Effects of Micro-Defects and Inclusions").

Low-oxygen clean steel according to an embodiment of the invention (hereinafter, may be referred to as the low-oxygen clean steel according to this embodiment) will be described in detail.

The low-oxygen clean steel according to this embodiment contains C, Si, Mn, P, and S as fundamental elements, further contains, by mass %, 0.005% to 0.20% of Al, greater than 0% to 0.0005% of Ca, 0.00005% to 0.0004% of REM, and greater than 0% to 0.003% of T.O, and if necessary, contains other elements.

In the low-oxygen clean steel according to this embodiment, the REM content, the Ca content, and the T.O content satisfy the following Expressions 1 and 2, and preferably satisfy the following Expression 3. In the steel, nonmetallic inclusions which have a maximum predicted diameter of 1 μm to 30 μm measured using an extreme value statistical method under the condition in which the prediction area is 30000 $mm^2$, and contain $Al_2O_3$ and REM oxide are dispersed. The average proportion of the $Al_2O_3$ in the nonmetallic inclusions is greater than 50%. The low-oxygen clean steel according to this embodiment is Al-deoxidized steel or Al—Si-deoxidized steel.

$$0.15 \leq REM/Ca \leq 4.00 \quad \text{Expression 1}$$

$$Ca/T.O \leq 0.50 \quad \text{Expression 2}$$

$$0.05 \leq REM/T.O \leq 0.50 \quad \text{Expression 3}$$

Here, REM is one or two or more of rare-earth elements La, Ce, Pr, and Nd.

As described above, in the low-oxygen clean steel according to this embodiment, nonmetallic inclusions containing fine $Al_2O_3$ and REM oxide are dispersed by the "suppression of the generation of the inclusions" and the "modification of the generated inclusions".

The effect of the "suppression of the generation of the inclusions" is obtained by controlling the Al content, the Ca content, and the T.O content within predetermined ranges.

The effect of the "modification of the generated inclusions" is obtained by a minute amount of REM of 0.00005 mass % to 0.0004 mass % (to be described later in detail). The inclusion modification effect of REM is obtained through a reducing action by REM with respect to CaO or CaO of CaO—$Al_2O_3$.

That is, in the low-oxygen clean steel according to this embodiment, it is important to control the amounts of Al, Ca, and T.O to 0.005 mass % to 0.20 mass %, to greater than 0 mass % to 0.0005 mass %, and to greater than 0 mass % to 0.003 mass %, respectively, from the viewpoint of the suppression of the generation of the inclusions, and it is important to control the amount of REM to 0.00005 mass % to 0.0004 mass % from the viewpoint of the modification of the generated inclusions.

Usually, steel contains C, Si, Mn, P, S, and if necessary, other elements with the remainder Fe and impurities. In the low-oxygen clean steel according to this embodiment, the above-described inclusion modification effect by REM is exhibited without being affected by molten steel components such as C, Si, and Mn other than Al, Ca, REM, and T.O. That is, it is not necessary to restrict the contents of elements other than Al, Ca, REM, and T.O. The inventors of the invention have confirmed this fact by way of experiment in an actual operation. The reasons for restriction of the respective contents will be described later.

Furthermore, the inventors of the invention have found that it is important for Al, Ca, REM, and T.O existing in a minute amount in the molten steel to be controlled not only in the content of each element, but also in the content ratio in order to appropriately maintain the mutual action and reaction between the elements and to maximize the inclusion modification effect by REM. Specifically, they have found that it is effective to control the ratio of REM to Ca, the ratio of REM to T.O, and the ratio of Ca to T.O as indices of the content ratios. The reasons for restriction of these content ratios will be described later.

First, the reasons for restriction of the component composition (chemical components) will be described. Hereinafter, % means mass %. In the low-oxygen clean steel according to this embodiment, chemical components are preferably within the following ranges in specimen of steel sampled from molten steel before casting based on JIS G 0417 or specimen of steel after casting Al: 0.005% to 0.20%

Al is a deoxidizing element and is an element which makes crystal grains of steel finer. In order to obtain these effects, the lower limit of the Al content is 0.005%. The lower limit of the Al content is preferably 0.010%.

When Al is contained in molten steel, the molten steel inevitably becomes Al-deoxidized molten steel and $Al_2O_3$-containing inclusions are generated in the molten steel. When the Al content in the molten steel is greater than 0.20%, the inclusions are generated in a large amount and remain in the steel and the fatigue properties of the steel deteriorate. Therefore, the upper limit of the Al content is 0.20%. The upper limit of the Al content is preferably 0.10%.

Ca: Greater than 0% to 0.0005%

Ca is a deoxidizing element and is an element which forms CaO—$Al_2O_3$-based inclusions which easily aggregate together and have a low melting point through a deoxidation reaction. When the Ca content in molten steel is greater than 0.0005%, $Al_2O_3$-based inclusions are made into CaO—$Al_2O_3$-based composite inclusions having a low melting point and coarsen. The CaO—$Al_2O_3$-based inclusions coarsening and remaining in the steel are not liquefied at a rolling temperature and remain in a coarse state in the steel. The amount of Ca is preferably as small as possible, but 0.0005% or less of Ca is permissible. Accordingly, the upper limit of the Ca content is 0.0005%. The upper limit of the Ca content is preferably 0.0003%, and more preferably 0.00025%.

In the current steelmaking method in which refining is performed by bringing slag containing CaO into contact with an upper portion of molten steel in a ladle, Ca is inevitably incorporated in the molten steel, and thus Ca cannot be completely eliminated from the steel. Therefore, the lower limit of the Ca content is greater than 0%.

In the low-oxygen clean steel according to this embodiment, the generation of CaO—$Al_2O_3$-based inclusions can be suppressed under the condition in which there is a minute amount of Ca incorporated inevitably in the molten steel.

In this embodiment, the Ca content is adjusted before the addition of REM. The method of suppressing the Ca content to 0.0005% or less in the course of refining will be described later.

REM: 0.00005% to 0.0004%

REM is an important element which modifies CaO—$Al_2O_3$-based inclusions by reducing CaO in molten steel and CaO in inclusions. The molten steel sufficiently deoxidized with Al or Al—Si contains 0.00005% to 0.0004% of REM (rare-earth element, one or two or more of La, Ce, Pr, and Nd) in order to obtain the inclusion modification effect. The inclusion modification effect cannot be obtained when the REM content is 0.00005% or less.

When the molten steel contains greater than 0.0004% REM, the inclusions increase in size. The detailed mechanism thereof is not clear, but is thought to be that when the molten steel contains greater than 0.0004% REM, a compound phase having a low melting point and a high REM concentration appears in the inclusions and promotes the aggregation of the inclusions, and thus the inclusions increase in size. Therefore, the upper limit of the REM content is 0.0004%. The upper limit of the REM content is preferably 0.0003%, and more preferably 0.0002%.

The range of the REM content is based on the result of the evaluation on the relationship between steel piece extreme value statistics (maximum predicted diameter) of the nonmetallic inclusions in the low-oxygen clean steel according to this embodiment calculated through an extreme value statistical method and fatigue strength.

FIG. 1 is a diagram showing the relationship between a maximum diameter (√area (μm)) of the nonmetallic inclusions and fatigue strength (MPa). From FIG. 1, it is found that the fatigue strength is improved with a decrease in grain diameter (√area (μm)) of the nonmetallic inclusions.

The component composition and the form (dimensions, shape) of the nonmetallic inclusions have a large influence on the fatigue strength of steel. The component composition and the form (dimensions, shape) of the nonmetallic inclusions will be described later.

Figure 2:
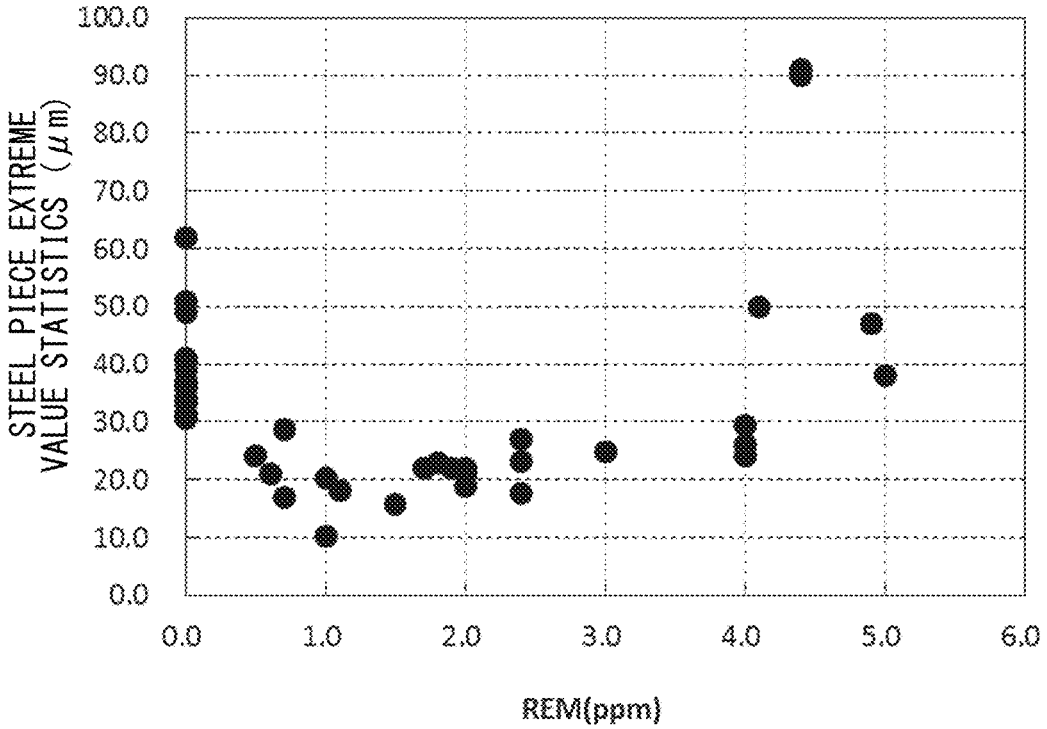
FIG. 2 is a diagram showing the relationship between an REM content (ppm) and steel piece extreme value statistics (maximum predicted diameter) (μm).

FIG. 2 shows the relationship between an REM content (ppm) and steel piece extreme value statistics (μm). The steel piece extreme value statistics (μm) provide an estimated value (maximum predicted diameter) of the maximum diameter of the inclusions existing in a predetermined test amount (prediction area) of a steel, which is obtained through an extreme value statistical method. In this embodiment, the steel piece extreme value statistics are calculated through an extreme value statistical method with a prediction area of 30,000 $mm^2$.

From FIG. 2, it is found that the REM content at which the steel piece extreme value statistics (μm) are 30 μm or less is 4 ppm (0.0004%) or less. In any analysis target steel, T.O was 5 ppm to 20 ppm and was within a preferable range of this embodiment. In the low-oxygen clean steel according to this embodiment, as described above, the upper limit of the REM content is 0.0004% based on the above description.

In addition, according to FIG. 2, the inclusion modification effect of REM is exhibited when the REM content is 0.5 ppm or greater. Accordingly, the lower limit of the REM content is 0.00005%. That is, the REM content is 0.00005% to 0.0004%. The REM content is preferably 0.00005% to 0.0003%, and more preferably 0.00005% to 0.0002%.

T.O: Greater than 0% to 0.003%

O is an element which exists in molten steel and forms an oxide. Accordingly, in producing steel which has excellent mechanical characteristics and in which a small amount of inclusions are finely dispersed, the T.O content is required to be controlled. In addition, it is also important to control the T.O content in the relationship with the contents of Ca and REM, which are constituent elements of oxide inclusions, in molten steel.

When the T.O content of molten steel is greater than 0.003%, oxide inclusions are generated in a large amount and remain in the steel, and mechanical characteristics, particularly, fatigue properties of the steel deteriorate. Therefore, the T.O content is 0.003% or less. The T.O content is preferably 0.002% or less, and more preferably 0.001% or less.

Although the amount of T.O is preferably as small as possible, the lower limit thereof is greater than 0% since it is difficult to adjust the amount of T.O to 0%.

Next, the reasons why the ratio of REM to Ca and the ratio of Ca to T.O are restricted to 0.15 to 4.00 and to 0.50 or less, respectively, and the reasons why the ratio of REM to T.O is preferably 0.05 to 0.50 in the low-oxygen clean steel according to this embodiment will be described.

REM/Ca: 0.15 to 4.00 ($0.15 \leq REM/Ca \leq 4.00$)

REM is an element which reduces CaO in inclusions to act for modification of the inclusions and suppression of coarsening. Therefore, the ratio of REM to Ca which is a ratio of the REM content to Ca content is an important index for maximizing the inclusion modification effect of REM.

Figure 3:
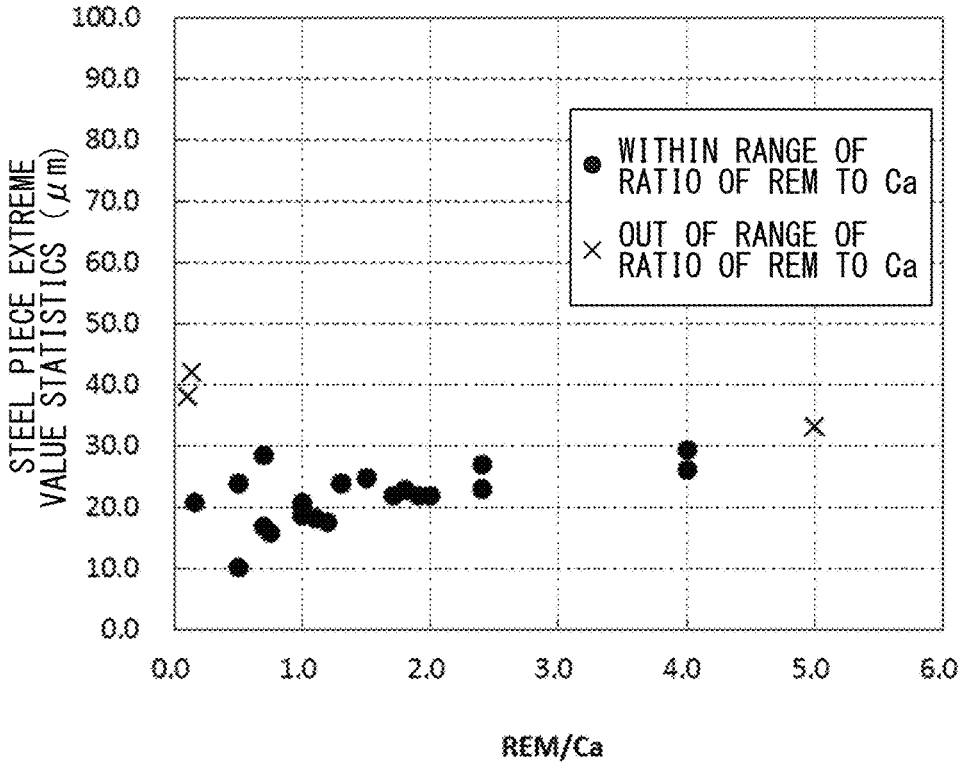
FIG. 3 is a diagram showing the relationship between a ratio of REM to Ca and steel piece extreme value statistics (μm).

FIG. 3 shows the relationship between the ratio of REM to Ca and steel piece extreme value statistics (μm).

From FIG. 3, it is found that the steel piece extreme value statistics (μm) are 30 μm or less when the ratio of REM to Ca is 0.15 to 4.00. When the ratio of REM to Ca is less than 0.15, the inclusions containing CaO—$Al_2O_3$ as a main component are not sufficiently modified. As a result, the inclusions have a grain diameter (steel piece extreme value statistics) greater than 30 μm, and thus coarsen and remain in the steel, and the mechanical characteristics thereof are not improved.

When the ratio of REM to Ca is greater than 4.00, the steel piece extreme value statistics (μm) are greater than 30 μm. The reason for this is assumed to be that since the molten steel has an excessively high REM content, the concentration of REM oxide in the inclusions to be generated excessively increases, and thus the composition of the inclusions is out of an appropriate range. The detailed mechanism thereof is not clear, but is presumed to be that when the REM concentration in the inclusions excessively increases, the inclusions aggregate together due to the generation of a low-melting-point phase in the inclusions, and as a result, the steel piece extreme value statistics (μm) are increased.

From the above description, the ratio of REM to Ca is 0.15 to 4.00. The ratio of REM to Ca is preferably 0.20 to 3.00, and more preferably 1.00 to 3.00.

Ca/T.O: 0.50 or Less ($Ca/T.O \leq 0.50$)

The ratio of Ca to T.O which is a ratio of the Ca content to the T.O content is an important index for suppressing the generation and coarsening of $CaO—Al_2O_3$-based inclusions and for maximizing the inclusion modification effect of REM.

Figure 5:
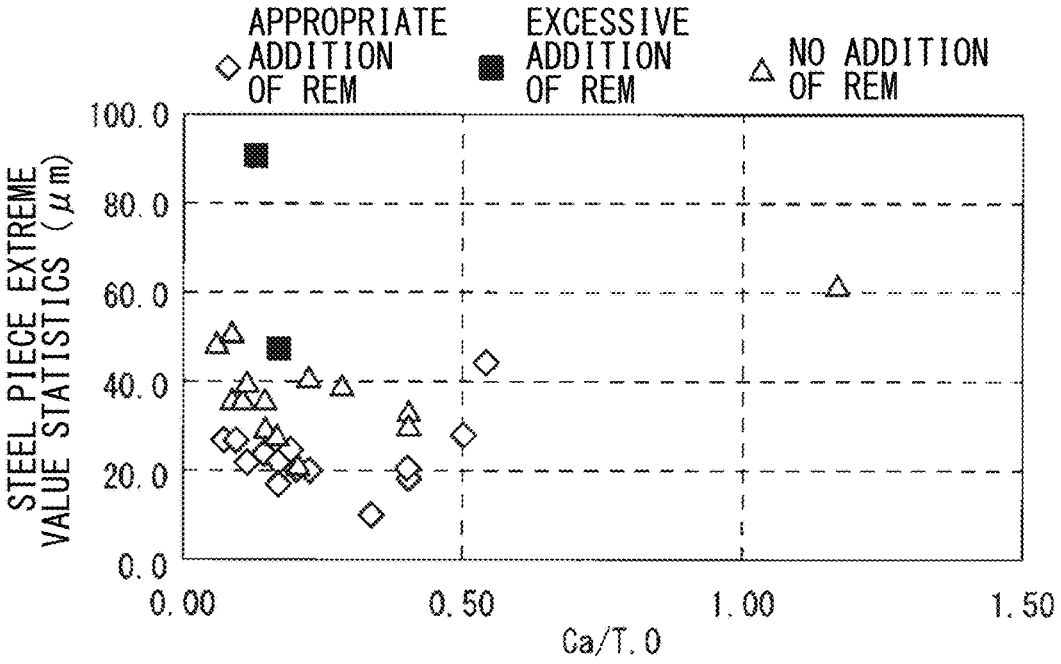
FIG. 5 is a diagram showing the relationship between the ratio of Ca to T.O and steel piece extreme value statistics (μm) analyzed when REM is appropriately added (0.00005% to 0.0004%), when REM is excessively added (greater than 0.0004%), and when REM is not added (the REM content is less than 0.00005%).

FIG. 5 shows the relationship between the ratio of Ca to T.O and steel piece extreme value statistics (μm) analyzed when REM is appropriately added (steel having an REM content of 0.00005% to 0.0004%), when REM is excessively added (steel having an REM content greater than 0.0004%), and when REM is not added (the REM content is less than 0.00005%).

From FIG. 5, it is found that in the case of the appropriate addition of REM indicated by ◇ in FIG. 5, the steel piece extreme value statistics are 30 μm or less when the ratio of Ca to T.O is 0.50 or less. The reason for this is presumed to be that when the ratio of Ca to T.O is 0.50 or less, the CaO activity of the inclusions is maintained at a high level, the reducing reaction of CaO by REM easily occurs, and thus the coarsening of the nonmetallic inclusions is suppressed.

Accordingly, the ratio of Ca to T.O is 0.50 or less. The ratio of Ca to T.O is preferably 0.10 to 0.40. When the Ca content is 0.00025% or less, the ratio of Ca to T.O is preferably 0.20 or less in order to suppress the coarsening of the inclusions by Ca.

REM/T.O: 0.05 to 0.50 ($0.05 \leq REM/T.O \leq 0.50$)

The ratio of REM to T.O is an effective index for sufficiently exhibiting the inclusion modification effect of REM. Accordingly, in addition to the ratio of REM to Ca and the ratio of Ca to T.O that have been described above, the ratio of REM to T.O is preferably 0.05 to 0.50 in order to prominently exhibit the inclusion modification effect of REM.

When the ratio of REM to T.O is greater than 0.50, CaO contributing as a binding agent in the aggregation of the inclusions and CaO of $CaO—Al_2O_3$ are reduced immediately after the addition of REM, but a large amount of unreacted REM (REM itself, which is a strong deoxidizing element) remains and excessively reduces $Al_2O_3$. As a result, $REM_2O_3—Al_2O_3$ inclusions are generated in a large amount and coarsen. Therefore, there is no contribution to an improvement in mechanical characteristics.

When the ratio of REM to T.O is less than 0.05, there is no sufficient contribution to the reduction of CaO and CaO of $CaO—Al_2O_3$, which contribute as a binding agent of the inclusions, and thus the inclusion modification effect is not sufficiently exhibited. Therefore, the effect of finely dispersing the nonmetallic inclusions in the steel is not obtained, and thus there is no contribution to an improvement in mechanical characteristics. Accordingly, the ratio of REM to T.O is preferably 0.05 to 0.50, and more preferably 0.10 to 0.40.

Figure 4:
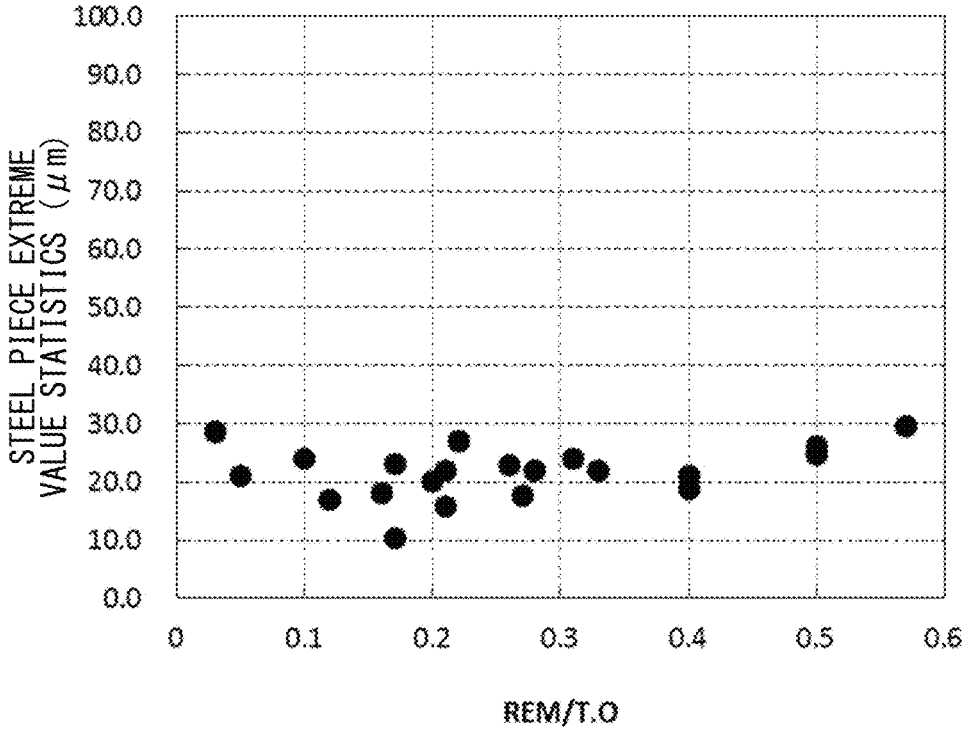
FIG. 4 is a diagram showing the relationship between a ratio of REM to T.O and steel piece extreme value statistics (μm).

FIG. 4 shows the relationship between the ratio of REM to T.O and steel piece extreme value statistics in steel having 0.003% or less of T.O. In FIG. 4, all of the REM content, the ratio of REM to Ca, the ratio of Ca to T.O, etc. are within the ranges of the low-oxygen clean steel according to this embodiment.

When REM satisfying the ratio of REM to T.O of 0.05 to 0.50, and preferably 0.10 to 0.40 is contained in clean molten steel having 0.003% or less of T.O, the REM sufficiently reduces CaO contributing as a binding agent in the aggregation of the inclusions and CaO of $CaO—Al_2O_3$ (that is, the inclusion modification effect is sufficiently exhibited). As a result, the inclusions do not aggregate and the nonmetallic inclusions are more finely dispersed.

Next, preferable contents of C, Si, and Mn, which are fundamental elements of molten steel, and P and S, which are impurity elements, will be described. As described above, in the low-oxygen clean steel according to this embodiment, the inclusion modification effect by REM is exhibited without being affected by steel components such as C, Si, and Mn other than Al, Ca, REM, and T.O. Therefore, it is not necessary to restrict the contents of elements other than Al, Ca, REM, and T.O. when obtaining the effect of this embodiment. However, in practical steel, the contents of C, Si, Mn, etc. are preferably controlled to secure predetermined characteristics. Hereinafter, a preferable component composition (chemical components) will be described based on the component composition of the practical steel.

C: 1.20% or Less

C is an effective element for securing the strength or hardness of steel after hardening. Types of steels which are not required to have such strength or hardness are not essentially required to contain C. Accordingly, the lower limit of the C content is not particularly restricted. However, since C is a fundamental element of steel and it is difficult to adjust the content thereof to 0%, the content of C cannot be 0%.

In the case of increasing the strength or the hardness, the C content is preferably 0.001% or greater. However, when the C content is greater than 1.20%, cracks are generated upon hardening or the steel becomes too hard, whereby the life of a cutting tool is deteriorated. Therefore, the upper limit of the C content is preferably 1.20%. The upper limit of the C content is more preferably 1.00%.

Si: 3.00% or Less

Si is an effective element for securing the strength or hardness by improving hardenability of steel. Types of steels which are not required to have such strength or hardness are not essentially required to contain Si. Accordingly, the lower limit of the Si content is not particularly restricted. However, since Si is a fundamental element of steel and it is difficult to adjust the content thereof to 0%, the content of Si cannot be 0%.

In the case of increasing the strength or the hardness of steel, the Si content is preferably 0.001% or greater. However, when the Si content is greater than 3.00%, the effect is saturated and the hardness of the steel excessively increases, whereby the life of a cutting tool is deteriorated. Therefore, the upper limit of the Si content is preferably 3.00%. The upper limit of the Si content is more preferably 2.50%.

Mn: 16.0% or Less

Mn is an effective element for securing the strength or hardness by improving hardenability of steel. Types of steels which are not required to have such strength or hardness are not essentially required to contain Mn. Accordingly, the lower limit of the Mn content is not particularly restricted. However, since Mn is a fundamental element of steel and it is difficult to adjust the content thereof to 0%, the content of Mn cannot be 0%.

In the case of increasing the strength or the hardness, the Mn content is preferably 0.001% or greater. However, when the Mn content is greater than 16.0%, quenching cracks are generated upon hardening or the steel becomes too hard, whereby the life of a cutting tool is deteriorated. Therefore, the upper limit of the Mn content is preferably 16.0%. The upper limit of the Mn content is more preferably 12.0%. When a certain amount of C (for example, 0.1% or greater) is contained, the strength of practical steel can be secured even when the Mn content is 2.0% or less.

P: 0.05% or Less

P is an impurity element, and when the P content is too large, the toughness of steel deteriorates. Therefore, the P content is preferably restricted to 0.05% or less, and more preferably to 0.03% or less. However, large refining cost is required to decrease the P content to 0.0001% or less. Therefore, the lower limit of the P content in practical steel is approximately 0.0001%.

S: 0.05% or Less

Similarly to P, S is an impurity element, and when the S content is too large, the toughness of steel deteriorates. Therefore, the S content is preferably restricted to 0.05% or less, and more preferably to 0.03% or less. Large refining cost is required to decrease the S content to 0.0001% or less. Therefore, the lower limit of the S content in practical steel is approximately 0.0001%.

The low-oxygen clean steel according to this embodiment may further contain one or two or more of 3.50% or less of Cr, 0.85% or less of Mo, 4.50% or less of Ni, 0.20% or less of Nb, 0.45% or less of V, and 0.30% or less of W other than the above-described elements in such a range as not to damage the characteristics thereof. Since it is not necessary to essentially contain these elements, the lower limits thereof are 0%.

Cr: 3.50% or Less

Cr is an effective element for securing the strength or hardness by improving hardenability of steel. The Cr content is preferably 0.01% or greater to obtain this effect. When the Cr content is greater than 3.50%, toughness and ductility deteriorate. Thus, the upper limit of the Cr content when Cr is contained is 3.50%. The upper limit of the Cr content is preferably 2.50%.

Mo: 0.85% or Less

Mo is an effective element for securing the strength or hardness by improving hardenability of steel. In addition, Mo is an element which forms carbide to contribute to an improvement in temper softening resistance. The Mo content is preferably 0.001% or greater when obtaining these effects. When the Mo content is greater than 0.85%, a supercooling structure which causes deterioration in toughness and ductility is easily generated. Thus, the upper limit of the Mo content when Mo is contained is 0.85%. The upper limit of the Mo content is preferably 0.65%.

Ni: 4.50% or Less

Ni is an effective element for securing the strength or hardness by improving hardenability. The Ni content is preferably 0.005% or greater to obtain this effect. When the Ni content is greater than 4.50%, toughness and ductility deteriorate. Thus, the upper limit of the Ni content when Ni is contained is 4.50%. The upper limit of the Ni content is preferably 3.50%.

Nb: 0.20% or Less

Nb is an element which forms carbide, nitride, or carbonitride to contribute to the prevention of coarsening of crystal grains and an improvement in temper softening resistance. The Nb content is preferably 0.001% or greater when obtaining these effects. When the Nb content is greater than 0.20%, toughness and ductility deteriorate. Thus, the upper limit of the Nb content when Nb is contained is 0.20%. The upper limit of the Ni content is preferably 0.10%.

V: 0.45% or Less

V is an element which forms carbide, nitride, or carbonitride to contribute to the prevention of coarsening of crystal grains and an improvement in temper softening resistance. The V content is preferably 0.001% or greater when obtaining these effects. When the V content is greater than 0.45%, toughness and ductility deteriorate. Thus, the upper limit of the V content when V is contained is 0.45%. The upper limit of the V content is preferably 0.35%.

W: 0.30% or Less

W is an effective element for securing the strength or hardness by improving hardenability of steel. In addition, W is an element which forms carbide to contribute to an improvement in temper softening resistance. The W content is preferably 0.001% or greater when obtaining these effects. When the W content is greater than 0.30%, a supercooling structure which causes deterioration in toughness and ductility is easily generated. Thus, the upper limit of the W content when W is contained is 0.30%. The upper limit of the W content is preferably 0.20%.

The low-oxygen clean steel according to this embodiment may further contain, by mass %, one or two or more of 0.006% or less of B, 0.06% or less of N, 0.25% or less of Ti, 0.50% or less of Cu, 0.45% or less of Pb, 0.20% or less of Bi, 0.01% or less of Te, 0.20% or less of Sb, and 0.001% or less of Mg other than the above-described elements in such a range as not to damage the characteristics thereof. Since it is not necessary to essentially contain these elements, the lower limits thereof are 0%.

B: 0.006% or Less

B is an element which increases hardenability of steel to contribute to an improvement in strength. In addition, B is an element which is segregated in austenite grain boundaries to suppress the grain boundary segregation of P and to improve fatigue strength. The B content is preferably 0.0001% or greater when obtaining these effects. When the B content is greater than 0.006%, the effect is saturated and embrittlement is caused. Therefore, the upper limit of the B content is 0.006% when B is contained. The upper limit of the B content is preferably 0.004%.

N: 0.06% or Less

N is an element which forms fine nitride to provide fine crystal grains and contributes to an improvement in strength and toughness. The N content is preferably 0.001% or greater when obtaining these effects. When the N content is greater than 0.06%, nitride is generated in an excessive amount, and thus toughness deteriorates. Therefore, the upper limit of the N content is 0.06% when N is contained. The upper limit of the N content is preferably 0.04%.

Ti: 0.25% or Less

Ti is an element which forms fine Ti nitride to provide fine crystal grains and contributes to an improvement in strength and toughness. The Ti content is preferably 0.0001% or greater when obtaining these effects. When the Ti content is greater than 0.25%, Ti nitride is generated in an excessive amount, and thus toughness deteriorates. Therefore, the upper limit of the Ti content is 0.25% when Ti is contained. The upper limit of the Ti content is preferably 0.15%.

Cu: 0.50% or Less

Cu is an element which increases corrosion resistance of steel. The Cu content is preferably 0.01% or greater to obtain this effect. When the Cu content is greater than 0.50%, hot ductility deteriorates, and thus cracks or flaws are caused. Therefore, the upper limit of the Cu content is 0.50% when Cu is contained. The upper limit of the Cu content is preferably 0.30%.

Pb: 0.45% or Less

Pb is an element which contributes to an improvement in machinability of steel. The Pb content is preferably 0.001% or greater to obtain this effect. When the Pb content is greater than 0.45%, toughness deteriorates. Therefore, the upper limit of the Pb content is 0.45% when Pb is contained. The upper limit of the Pb content is preferably 0.30%.

Bi: 0.20% or Less

Bi is an element which contributes to an improvement in machinability of steel. The Bi content is preferably 0.001% or greater to obtain this effect. When the Bi content is greater than 0.20%, toughness deteriorates. Therefore, the upper limit of the Bi content is 0.20% when Bi is contained. The upper limit of the Bi content is preferably 0.10%.

Te: 0.01% or Less

Te is an element which contributes to an improvement in machinability of steel. The Te content is preferably 0.0001% or greater to obtain this effect. When the Te content is greater than 0.01%, toughness deteriorates. Therefore, the upper limit of the Te content is 0.01% when Te is contained. The upper limit of the Te content is preferably 0.005%.

Sb: 0.20% or less

Sb is an element which contributes to an improvement in corrosion resistance based on sulfuric acid resistance and hydrochloric acid resistance and an improvement in machinability. The Sb content is preferably 0.001% or greater when obtaining these effects. When the Sb content is greater than 0.20%, toughness deteriorates. Therefore, the upper limit of the Sb content is 0.20% when Sb is contained. The upper limit of the Sb content is preferably 0.10%.

Mg: 0.01% or Less

Mg is an element which contributes to an improvement in machinability of steel. The Mg content is preferably 0.0001% or greater to obtain this effect. When the Mg content is greater than 0.01%, toughness deteriorates. Therefore, the upper limit of the Mg content is 0.01% when Mg is contained. The upper limit of the Mg content is preferably 0.005%.

Next, the nonmetallic inclusions existing in a finely dispersed manner in the low-oxygen clean steel according to this embodiment will be described.

The low-oxygen clean steel according to this embodiment is obtained by adding, by mass %, 0.00005% to 0.0004% of REM to molten steel which contains 0.005% to 0.20% of Al, 0.0005% or less of Ca, and 0.003% or less of T.O and in which the ratio of Ca to T.O is 0.50 or less. The low-oxygen clean steel according to this embodiment satisfies (x1) the ratio of REM to Ca is 0.15 to 4.00 and (y) the ratio of Ca to T.O is 0.50 or less, and preferably further satisfies (x2) the ratio of REM to T.O is 0.05 to 0.50.

Molten steel having the following chemical components: 0.005% to 0.20% of Al; 0.0005% or less of Ca; and 0.003% or less of T.O, in which the ratio of Ca to T.O is 0.50 or less, is used when obtaining the low-oxygen clean steel according to this embodiment. In such molten steel, the amount of CaO existing in the molten steel and the amount of $CaO—Al_2O_3$ inclusions are small.

When REM is added to the molten steel in the above state in an amount of 0.00005% to 0.0004% such that the above-described (x1) (preferably further (x2)) is satisfied, the REM reduces CaO, acting as a binding agent to promote the aggregation of the inclusions, FeO, compounds such as $FeO—Al_2O_3$, and CaO in $CaO—Al_2O_3$ inclusions. As a result, (i) the $CaO—Al_2O_3$ inclusions are modified into $Al_2O_3$-based and/or $REM_2O_3$-based inclusions, and (ii) the aggregation of $Al_2O_3$-based inclusions, $Al_2O_3$—MgO-based inclusions, and $REM_2O_3$-based inclusions is suppressed, whereby the inclusions do not coarsen.

That is, fine nonmetallic inclusions are generated in the molten steel by adding REM as described above. Accordingly, the low-oxygen clean steel according to this embodiment obtained by casting the molten steel in which the fine nonmetallic inclusions exist is capable of obtaining a structure in which the nonmetallic inclusions are finely dispersed. The nonmetallic inclusions are fine and have a size of 30 μm or less even in terms of the maximum predicted diameter obtained using an extreme value statistical method with a prediction area of 30,000 $mm^2$. In addition, since the nonmetallic inclusions are fine, fatigue fracture hardly occurs therefrom as is apparent fracture-mechanically. Therefore, the mechanical characteristics, particularly, fatigue properties of the low-oxygen clean steel according to this embodiment are significantly improved. This is the most important characteristic of the low-oxygen clean steel according to this embodiment.

In this embodiment, the maximum predicted diameter of the inclusions is a value estimated using, for example, the extreme value statistical method described in "Metal Fatigue, Effects of Micro-Defects and Inclusions" (written by Yukitaka Murakami, Yokendo, published in 1993, P. 223 to 239). The maximum predicted diameter (√area (max)) of the inclusions is calculated through the expression: $\sqrt{area}\ (max)=(a^2+b^2)^{1/2}$ where a is a major axis and b is a minor axis perpendicular to the major axis.

Figure 6:
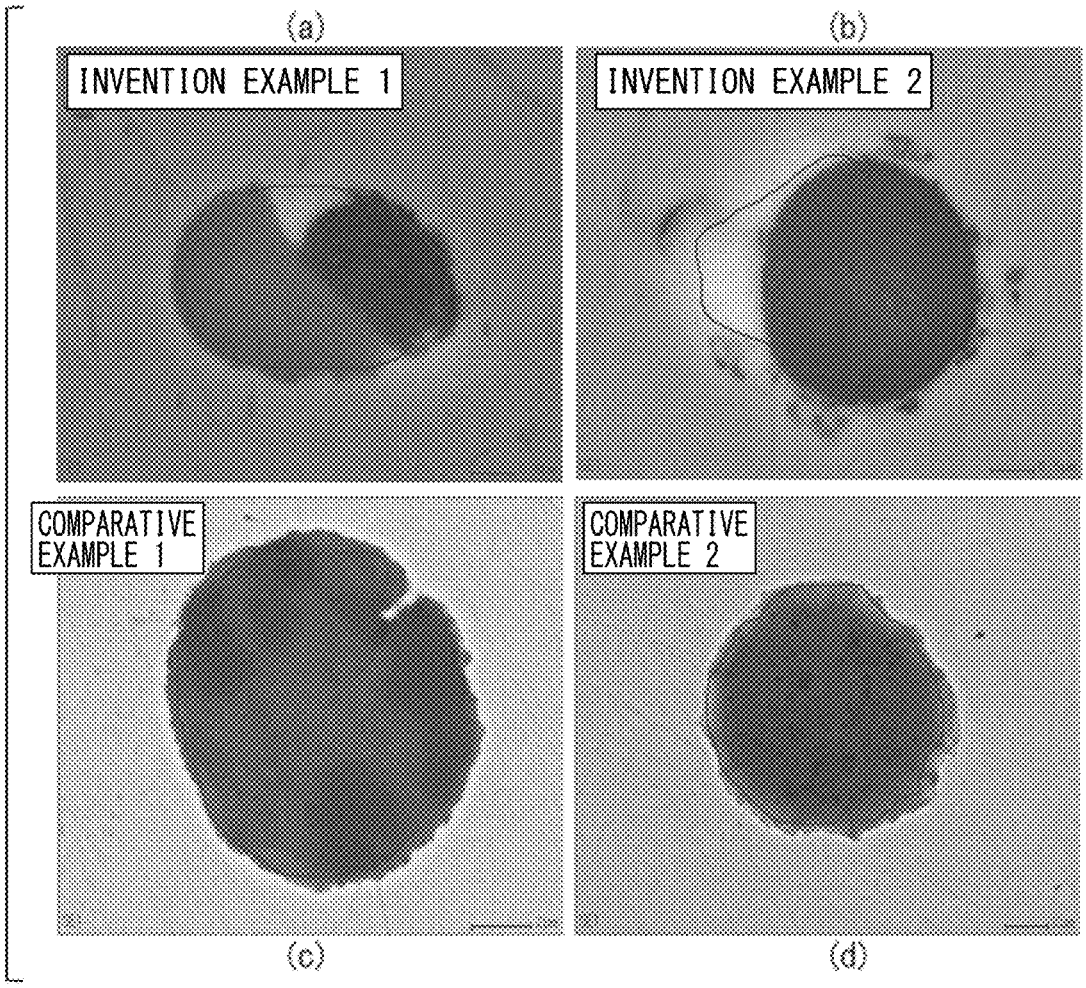
FIG. 6 shows diagrams showing forms (SEM reflected electron images) of nonmetallic inclusions existing in steel.

FIG. 6 shows typical forms of nonmetallic inclusions existing in steel (SEM reflected electron image). These are forms of nonmetallic inclusions detected when evaluating steel piece extreme value statistics in examples to be described later. FIGS. 6(*a*) and 6(*b*) show forms of nonmetallic inclusions of invention examples (No. 2-1 in Tables 2-1 and 2-2 to be shown later) (type of steel: suspension spring A), and FIGS. 6(*c*) and 6(*d*) show representative forms of nonmetallic inclusions of comparative examples (No. 2-2 in Tables 2-1 and 2-2 to be shown later) (type of steel: suspension spring A).

The diameter (see black borders) of the nonmetallic inclusions of the comparative examples shown in FIGS. 6(*c*) and 6(*d*) is on the order of tens of-μm. The diameter (see black borders) of the nonmetallic inclusions of the invention examples shown in FIGS. 6(*a*) and 6(*b*) is on the order of several-μm. "Fine nonmetallic inclusions" exist in various shapes in the low-oxygen clean steel according to this embodiment as shown in FIGS. 6(*a*) and 6(*b*). Since the nonmetallic inclusions are fine due to the modification with REM, fatigue fracture hardly occurs therefrom. The inventors of the invention have confirmed this fact by way of experiment in an actual operation with respect to main types of steels which are used in spring steel, bearing steel, case hardening steel etc.

The above-described fact that fatigue fracture hardly occurs from the fine nonmetallic inclusions also relates to the component composition of the nonmetallic inclusions. Hereinafter, the component composition of the nonmetallic inclusions will be described.

Table 1 shows component compositions of the above-described nonmetallic inclusions shown in FIGS. 6(*a*) to 6(*d*). Table 1 also shows component compositions, which are separately observed from those in FIGS. 6(*a*) to 6(*d*), of nonmetallic inclusions (Invention Examples 3 to 12) of the low-oxygen clean steels according to this embodiment and nonmetallic inclusions (Comparative Examples 3 to 6) of comparative steels. The component composition of the nonmetallic inclusions was measured as follows.

The average composition of one inclusion detected by an optical microscope is measured using an energy dispersive X-ray analysis method to analyze the composition of Mg, Al, Si, Ca, La, Ce, Nd, Mn, Ti, and S. Since Mn and Ca form both of oxide and sulfide, S is allowed to form sulfide in order of MnS and CaS and the remaining Ca and Mn are analyzed as oxide. When obtaining the average of the inclusion composition, the number average may be taken after examining the compositions of a plurality of inclusions as described above.

The nonmetallic inclusions shown in FIG. 6 have a difference in contrast therebetween. This shows that the nonmetallic inclusions have a mixed phase of oxide and sulfide, but the fact that the nonmetallic inclusions have a mixed phase does not have a dominant influence on fatigue properties. This is consistent with the relationship between the grain diameter of the nonmetallic inclusions and the fatigue strength shown in FIG. 1.

less). When deoxidation is sufficiently performed with Al or Al—Si, the nonmetallic inclusions almost contain no $TiO_2$ and $SiO_2$.

Even when one or two or more of CaS, MnS, REM sulfide and MgO (compound layer) exist in inclusions having $Al_2O_3$ and REM oxide as main components, the influence on the

TABLE 1

| | | SIZE | COMPONENT COMPOSITION (MASS %: BASED ON 100% OF OXIDE) | | | | | | | | | (ADDITIONAL) | | | $Al_2O_3$ + |
|---|---|---|---|---|---|---|---|---|---|---|---|---|---|---|---|
| No | CLASSIFICATION | μm*μm | MgO | $Al_2O3$ | $SiO_2$ | CaO | $La_2O_3$ | $Ce_2O_3$ | $Nd_2O_3$ | MnO | TiO2 | MnS | CaS | $REM_2O_3$ | REM |
| 2-1 | INVENTION EXAMPLE 1 | 4*4 | 2.9 | 53.3 | 0 | 0 | 14.2 | 22.1 | 7.5 | 0 | 0 | 31.1 | 10.2 | 43.8 | 97.1 |
| 2-1 | INVENTION EXAMPLE 2 | 4*3 | 14.1 | 56.3 | 0 | 0 | 11.2 | 16.5 | 1.9 | 0 | 0 | 11.2 | 13.6 | 29.6 | 85.9 |
| 2-2 | COMPARATIVE EXAMPLE1 | 10*9 | 8.7 | 67.6 | 7.2 | 16.5 | 0 | 0 | 0 | 0 | 0 | 0 | 3.7 | 0 | 67.6 |
| 2-2 | COMPARATIVE EXAMPLE2 | 13*10 | 1.4 | 69.2 | 5.1 | 24.3 | 0 | 0 | 0 | 0 | 0 | 0 | 14.0 | 0 | 69.2 |
| 1-1 | INVENTION EXAMPLE3 | 12*5 | 18.2 | 53.6 | 0 | 0 | 1.4 | 24.4 | 2.5 | 0 | 0 | 9.3 | 29.4 | 28.2 | 81.8 |
| 1-1 | INVENTION EXAMPLE4 | 9*4 | 23.9 | 56.2 | 0 | 0 | 4.8 | 9.9 | 5.2 | 0 | 0 | 12.3 | 13.2 | 19.9 | 76. 1 |
| 1-1 | INVENTION EXAMPLE5 | 7*6 | 26.8 | 73.2 | 0 | 0 | 0 | 0 | 0 | 0 | 0 | 0 | 0 | 0 | 73.2 |
| 1-3 | INVENTION EXAMPLE6 | 31*4 | 3.5 | 49.1 | 0 | 0 | 16.6 | 25.3 | 5.6 | 0 | 0 | 7.4 | 11.8 | 47.4 | 96.5 |
| 1-3 | INVENTION EXAMPLE7 | 11*6 | 4.7 | 66.0 | 0 | 0 | 9.8 | 16.4 | 3.1 | 0 | 0 | 0 | 3.9 | 29.3 | 95.3 |
| 1-5 | COMPARATIVE EXAMPLE3 | 20*17 | 22.4 | 77.6 | 0 | 0 | 0 | 0 | 0 | 0 | 0 | 0 | 6.4 | 0 | 77.6 |
| 1-5 | COMPARATIVE EXAMPLE4 | 10*9 | 5.0 | 89.8 | 0 | 5.3 | 0 | 0 | 0 | 0 | 0 | 0 | 27.0 | 0 | 89.8 |
| 1-6 | COMPARATIVE EXAMPLE5 | 20*7 | 18.2 | 81.6 | 0 | 0.2 | 0 | 0 | 0 | 0 | 0 | 0 | 23.9 | 0 | 81.6 |
| 1-6 | COMPARATIVE EXAMPLE6 | 28*7 | 22.7 | 77.3 | 0 | 0 | 0 | 0 | 0 | 0 | 0 | 0 | 44 | 0 | 77.3 |
| 4-1 | INVENTION EXAMPLE8 | 14*10 | 15.0 | 62.1 | 0 | 0.3 | 6.3 | 16.4 | 0 | 0 | 0 | 2.1 | 0 | 22.7 | 84.8 |
| 6-10 | INVENTION EXAMPLE9 | 14*9 | 16.3 | 82.9 | 0.8 | 0 | 0 | 0 | 0 | 0 | 0 | 8 | 19 | 0 | 82.9 |
| 6-10 | INVENTION EXAMPLE10 | 8*7 | 17.5 | 57.6 | 0 | 1.0 | 10.0 | 14.0 | 0 | 0 | 0 | 8 | 10 | 24.0 | 81.6 |
| 6-10 | INVENTION EXAMPLE11 | 10*7 | 9.1 | 63.4 | 0 | 0.3 | 9.2 | 18.0 | 0 | 0 | 0 | 2 | 8 | 27.2 | 90.6 |
| 6-10 | INVENTION EXAMPLE12 | 7*5 | 24.9 | 74.5 | 0.6 | 0 | 0 | 0 | 0 | 0 | 0 | 3 | 15 | 0 | 74.5 |

The inclusion compositions of FIGS. 6(*a*) and 6(*b*) are shown in Invention Examples 1 and 2 of Table 1, and the inclusion compositions of FIGS. 6(*c*) and 6(*d*) are shown by mass % in Comparative Examples 1 and 2 of Table 1. In Comparative Examples 1 and 2 and further Comparative Examples 3 to 6, the inclusions are not modified with REM. However, in Invention Examples 1 and 2 and further Invention Examples 3 to 12, the inclusions are modified with REM.

As is apparent from Table 1, $Al_2O_3$ and/or CaO are main components in Comparative Examples 1 and 2 and further Comparative Examples 3 to 6. $Al_2O_3$ and REM oxide are main components in Invention Examples 1 and 2 and further Invention Examples 3 to 12. In addition, the average proportion of $Al_2O_3$ in the inclusions in each example exceeds 50%.

CaO in Comparative Examples 1 is 16.5% and CaO in Comparative Example 2 is 24.3%. These are values higher than 10%. In the invention examples, CaO is 1.0% or less and significantly lower than in the comparative examples.

In the case of the inclusions of the invention examples, $TiO_2$ and $SiO_2$ are almost undetected (for example, 1.0% or size of the inclusions is small. For example, in the case of the nonmetallic inclusions of Invention Example 1 in Table 1, 31.1 mass % of MnS and 10.2 mass % of CaS (total: 41.3 mass %) additionally exist, and in the case of the nonmetallic inclusions of Invention Example 2, 11.2 mass % of MnS and 13.6 mass % of CaS (total: 24.5 mass %) additionally exist.

Even when CaS and MnS exist in an amount of approximately 0% to 42% in inclusions having $Al_2O_3$ and REM oxide as main components, the size of the inclusions is kept small in the range of the analysis. In addition, fatigue properties are not affected by the existence of CaS and MnS, and thus the influence of the existence of CaS and MnS on fatigue properties is confirmed to be sufficiently small.

A preferable low-oxygen clean steel according to this embodiment will be described.

Similarly to general steel, a low-oxygen clean steel according to an embodiment is preferably obtained by rolling a steel piece obtained through a refining process and a casting process or the like. As the processing processes such as the casting process and rolling, arbitrary methods can be employed so as to provide a desired shape and desired characteristics.

As for the low-oxygen clean steel according to this embodiment, it is important to add, by mass %, 0.00005% to 0.0004% of REM to molten steel which contains 0.005% to 0.20% of Al, 0.0005% or less of Ca, and 0.003% or less of T.O and in which the ratio of Ca to T.O is 0.50 or less.

Therefore, in the refining process, the Ca content is preferably restricted and REM is preferably contained in the molten steel through the following method in the following manner.

<Method of Restricting Ca Content>

Various types of auxiliary raw materials and alloy iron are added to molten steel when the molten steel is subjected to refining and component adjustment. In general, since the auxiliary raw materials and alloy iron contain Ca in various forms, it is important to manage the timing of addition of the auxiliary raw materials and alloy iron and the Ca content contained therein in order to adjust the Ca content to 0.0005% or less.

Ca in the alloy iron is contained as an alloy component at a high ratio. Accordingly, in the case of molten steel deoxidized with Al or Al—Si, the yield of Ca in the molten steel is high. Thus, it is necessary to avoid the addition of alloy iron having a high Ca content.

Therefore, the amount of Ca to be added is preferably decreased using, for example, alloy iron having 1.0% or less of Ca. In addition, since quicklime, dolomite etc. to be added as a slag-making material contain Ca in the form of mainly oxide, it is incorporated in slag when floating separation is sufficiently conducted. However, since the floating separation cannot be sufficiently conducted during the terminal stages of secondary refining, the addition is avoided. Other than quicklime, dolomite, CaO-containing recycle slag may be used as a slag-making material.

In addition, in Al-deoxidized steel and Al—Si-deoxidized steel, it is important to suspend no CaO in the molten steel to suppress the generation of CaO—$Al_2O_3$-based inclusions. During the terminal stages of secondary refining, stirring of molten steel and slag containing CaO in a large amount is suppressed. For example, strong stirring by Ar blowing into a ladle should be avoided. When the molten steel is stirred from the viewpoint of uniform REM concentration, a stirring method such as electromagnetic stirring is used in which the slag is not incorporated into the molten steel.

<Method of Adding REM>

CaO adheres to inclusions having $Al_2O_3$ as a main component and functions as a binding agent to promote coarsening. REM acting to reduce the CaO is added in an amount of 0.00005% to 0.0004% to molten steel in which ladle slag refining has been completed by sufficient deoxidation with Al or Al—Si. It is not preferable that REM be added before deoxidation with Al or Al—Si be performed since the inclusions coarsen.

For example, in a common secondary refining process including ladle electrode heating and vacuum degassing, molten steel is deoxidized by ladle electrode heating, and then REM is added to the molten steel in the vacuum degassing process. REM may be added to a tundish or the molten steel in a mold.

Since REM is added to the molten steel in a minute amount, the molten steel is preferably stirred to uniformize the REM concentration in the molten steel after the addition. For the stirring of the molten steel, stirring in a vacuum chamber in the vacuum degassing process, stirring in the tundish by flowing of the molten steel, and electromagnetic stirring in the mold can be applied.

REM may be added in the form of any of pure metal such as Ce and La, alloy of REM metals, or alloy with other alloys. When REM is added, the shape thereof is preferably a lump-like shape, a grain shape, or a wire shape from the viewpoint of yield.

A low-oxygen clean steel product according to this embodiment can be produced by processing the low-oxygen clean steel according to this embodiment using an arbitrary method.

EXAMPLES

Next, examples of the invention will be described. Conditions in the invention examples are just an examples employed to confirm the feasibility and effects of the invention. Therefore, the invention is not restricted to these examples. The invention can employ various conditions so long as not departing from the gist of the invention while achieving the object of the invention.

Example 1

A steel piece was produced by casting molten steel having a component composition shown in Table 2-1. The slag composition and the conditions of auxiliary raw materials at the time of refining are shown together in Table 2-2. In the column of "conditions of auxiliary raw materials", a Ca source (CaSi or FeSi) to be put into the molten steel and the mass percent of Ca in FeSi are shown. The component composition includes the remainder Fe and impurities.

Using the above-described steel piece, steel piece extreme value statistics (maximum predicted diameter) (μm) of nonmetallic inclusions in a prediction area of 30,000 $mm^2$ were estimated through an extreme value statistical method. The results are shown together in Table 2-2. When the steel piece extreme value statistics are 30 μm or less, the level is set to pass (G: GOOD), when the steel piece extreme value statistics are greater than 30 μm to 37 μm, the level is set to B (BAD), and when the steel piece extreme value statistics are greater than 37 μm, the level is set to VB (VERY BAD). FIGS. 6(*a*) and 6(*b*) show the forms of the nonmetallic inclusions of Invention Example No. 2-1, and FIGS. 6(*c*) and 6(*d*) show the forms of the nonmetallic inclusions of Comparative Example 2-2.

TABLE 2-1

| | | COMPONENT COMPOSITION CHEMICAL COMPONENTS | | | | | | | | | | | | | |
|---|---|---|---|---|---|---|---|---|---|---|---|---|---|---|---|
| | | (MASS %) | | | | | | | | (MASS % · × $10^4$) | | | (−) | | |
| No. | | C | Si | Mn | T•Al | P | S | Cr | Mo | T•O | Ca | REM | Ca/T•O | REM/T•O | REM/Ca |
| 1-1 | INVENTION EXAMPLE | 1.00 | 0.25 | 0.37 | 0.012 | 0.009 | 0.001 | 1.44 | 0.01 | 4 | 2 | 2.0 | 0.4 | 0.4 | 1.0 |
| 1-2 | INVENTION EXAMPLE | 0.99 | 0.26 | 0.38 | 0.013 | 0.012 | 0.001 | 1.43 | 0.00 | 5 | 2 | 2.0 | 0.4 | 0.4 | 1.0 |

TABLE 2-1-continued

| No. | | COMPONENT COMPOSITION CHEMICAL COMPONENTS (MASS %) C | Si | Mn | T•Al | P | S | Cr | Mo | (MASS % · × $10^4$) T•O | Ca | REM | (−) Ca/T•O | REM/T•O | REM/Ca |
|---|---|---|---|---|---|---|---|---|---|---|---|---|---|---|---|
| 1-3 | INVENTION EXAMPLE | 1.00 | 0.26 | 0.38 | 0.010 | 0.009 | 0.002 | 1.43 | 0.00 | 5 | 1 | 1.0 | 0.2 | 0.2 | 1.0 |
| 1-4 | INVENTION EXAMPLE | 1.00 | 0.25 | 0.37 | 0.008 | 0.011 | 0.001 | 1.42 | 0.00 | 5 | 1 | 0.5 | 0.2 | 0.1 | 0.5 |
| 1-5 | COMPARATIVE EXAMPLE | 1.00 | 0.26 | 0.37 | 0.018 | 0.009 | 0.001 | 1.43 | 0.00 | 5 | 1 | 0.0 | 0.2 | 0 | 0.0 |
| 1-6 | COMPARATIVE EXAMPLE | 0.99 | 0.25 | 0.37 | 0.009 | 0.006 | 0.001 | 1.42 | 0.01 | 5 | 1 | 0.0 | 0.2 | 0 | 0.0 |
| 2-1 | INVENTION EXAMPLE | 0.52 | 1.51 | 0.49 | 0.026 | 0.013 | 0.012 | 0.73 | 0.09 | 6 | 2 | 1.0 | 0.33 | 0.17 | 0.5 |
| 2-2 | COMPARATIVE EXAMPLE | 0.53 | 1.53 | 0.48 | 0.025 | 0.009 | 0.012 | 0.72 | 0.09 | 10 | 1 | 0.0 | 0.1 | 0 | 0.0 |
| 2-3 | COMPARATIVE EXAMPLE | 0.53 | 1.49 | 0.50 | 0.024 | 0.013 | 0.012 | 0.72 | 0.09 | 5 | 1 | 0.0 | 0.2 | 0 | 0.0 |
| 3-1 | COMPARATIVE EXAMPLE | 0.49 | 1.96 | 0.70 | 0.023 | 0.007 | 0.002 | 0.52 | 0.01 | 6 | 1 | 0.0 | 0.17 | 0 | 0.0 |
| 3-2 | COMPARATIVE EXAMPLE | 0.50 | 1.92 | 0.70 | 0.022 | 0.006 | 0.002 | 0.53 | 0.01 | 7 | 1 | 0.0 | 0.14 | 0 | 0.0 |
| 3-3 | COMPARATIVE EXAMPLE | 0.48 | 1.97 | 0.70 | 0.023 | 0.010 | 0.001 | 0.51 | 0.01 | 5 | 2 | 0.0 | 0.4 | 0 | 0.0 |
| 3-4 | COMPARATIVE EXAMPLE | 0.48 | 1.93 | 0.69 | 0.024 | 0.009 | 0.002 | 0.52 | 0.01 | 10 | 4 | 0.0 | 0.4 | 0 | 0.0 |
| 3-5 | COMPARATIVE EXAMPLE | 0.50 | 1.96 | 0.70 | 0.020 | 0.007 | 0.001 | 0.53 | 0.01 | 7 | 2 | 0.0 | 0.29 | 0 | 0.0 |
| 3-6 | COMPARATIVE EXAMPLE | 0.50 | 1.98 | 0.70 | 0.023 | 0.008 | 0.003 | 0.53 | 0.01 | 12 | 1 | 0.0 | 0.08 | 0 | 0.0 |
| 3-7 | COMPARATIVE EXAMPLE | 0.49 | 1.97 | 0.68 | 0.021 | 0.005 | 0.001 | 0.51 | 0.01 | 12 | 6 | 0.8 | 0.50 | 0.07 | 0.13 |
| 4-1 | INVENTION EXAMPLE | 0.20 | 0.20 | 0.78 | 0.026 | 0.019 | 0.013 | 0.95 | 0.16 | 6 | 1 | 1.7 | 0.17 | 0.28 | 1.7 |
| 4-2 | INVENTION EXAMPLE | 0.15 | 0.21 | 0.80 | 0.025 | 0.013 | 0.015 | 1.00 | 0.16 | 11 | 1 | 2.4 | 0.09 | 0.22 | 2.4 |
| 4-3 | INVENTION EXAMPLE | 0.41 | 0.26 | 0.75 | 0.023 | 0.013 | 0.019 | 1.11 | 0.16 | 9 | 2 | 2.4 | 0.22 | 0.27 | 1.2 |
| 4-4 | INVENTION EXAMPLE | 0.20 | 0.20 | 0.80 | 0.025 | 0.025 | 0.020 | 1.12 | 0.01 | 6 | 2 | 3.0 | 0.33 | 0.5 | 1.5 |
| 4-5 | COMPARATIVE EXAMPLE | 0.20 | 0.20 | 0.79 | 0.025 | 0.021 | 0.009 | 1.10 | 0.01 | 8 | 2 | 5.0 | 0.25 | 0.63 | 2.5 |
| 4-6 | COMPARATIVE EXAMPLE | 0.40 | 0.25 | 0.80 | 0.025 | 0.012 | 0.003 | 1.11 | 0.16 | 6 | 1 | 4.9 | 0.17 | 0.82 | 4.9 |
| 4-7 | COMPARATIVE EXAMPLE | 0.28 | 0.21 | 0.87 | 0.025 | 0.018 | 0.014 | 1.22 | 0.29 | 7 | 1 | 0.0 | 0.14 | 0 | 0.0 |
| 4-8 | COMPARATIVE EXAMPLE | 0.23 | 0.22 | 0.88 | 0.024 | 0.015 | 0.013 | 1.22 | 0.29 | 21 | 0.8 | 4.0 | 0.04 | 0.19 | 5.00 |
| 4-9 | COMPARATIVE EXAMPLE | 0.22 | 0.23 | 0.88 | 0.026 | 0.011 | 0.012 | 1.21 | 0.28 | 16 | 8 | 0.8 | 0.50 | 0.05 | 0.10 |
| 5-1 | INVENTION EXAMPLE | 0.17 | 0.03 | 0.75 | 0.046 | 0.012 | 0.003 | 0.03 | 0.00 | 14 | 1 | 2.4 | 0.07 | 0.17 | 2.4 |
| 5-2 | INVENTION EXAMPLE | 0.16 | 0.02 | 0.77 | 0.049 | 0.011 | 0.008 | 0.03 | 0.00 | 9 | 1 | 1.9 | 0.11 | 0.21 | 1.9 |
| 5-3 | INVENTION EXAMPLE | 0.13 | 0.03 | 0.36 | 0.026 | 0.013 | 0.007 | 0.03 | 0.00 | 13 | 3 | 4.0 | 0.23 | 0.31 | 1.3 |
| 5-4 | COMPARATIVE EXAMPLE | 0.16 | 0.04 | 0.76 | 0.043 | 0.016 | 0.006 | 0.03 | 0.00 | 17 | 1 | 0.0 | 0.06 | 0 | 0.0 |
| 5-5 | COMPARATIVE EXAMPLE | 0.17 | 0.04 | 0.77 | 0.049 | 0.012 | 0.012 | 0.07 | 0.00 | 12 | 1 | 0.0 | 0.08 | 0 | 0.0 |
| 5-6 | COMPARATIVE EXAMPLE | 0.15 | 0.04 | 0.74 | 0.060 | 0.009 | 0.011 | 0.03 | 0.00 | 8 | 5 | 1.5 | 0.63 | 0.19 | 0.30 |
| 6-1 | INVENTION EXAMPLE | 0.55 | 0.20 | 0.76 | 0.024 | 0.009 | 0.002 | 0.14 | 0.01 | 7 | 1 | 1.8 | 0.14 | 0.26 | 1.8 |
| 6-2 | INVENTION EXAMPLE | 0.43 | 0.26 | 0.78 | 0.024 | 0.012 | 0.016 | 0.13 | 0.00 | 6 | 1 | 2.0 | 0.17 | 0.33 | 2.0 |
| 6-3 | INVENTION EXAMPLE | 0.34 | 0.23 | 0.75 | 0.025 | 0.018 | 0.024 | 0.05 | 0.01 | 6 | 1 | 0.7 | 0.17 | 0.12 | 0.7 |
| 6-4 | INVENTION EXAMPLE | 0.20 | 0.17 | 0.80 | 0.035 | 0.012 | 0.006 | 0.37 | 0.01 | 7 | 1 | 1.1 | 0.14 | 0.16 | 1.1 |
| 6-5 | INVENTION EXAMPLE | 0.32 | 0.20 | 0.75 | 0.025 | 0.022 | 0.030 | 0.15 | 0.01 | 8 | 1 | 4.0 | 0.13 | 0.5 | 4.0 |
| 6-6 | INVENTION EXAMPLE | 0.34 | 0.21 | 0.77 | 0.022 | 0.024 | 0.029 | 0.01 | 0.01 | 12 | 4 | 0.6 | 0.33 | 0.05 | 0.2 |
| 6-7 | COMPARATIVE EXAMPLE | 0.33 | 0.23 | 0.75 | 0.028 | 0.008 | 0.003 | 0.07 | 0.00 | 8 | 1 | 4.1 | 0.13 | 0.52 | 4.1 |
| 6-8 | COMPARATIVE EXAMPLE | 0.35 | 0.22 | 0.75 | 0.024 | 0.015 | 0.024 | 0.06 | 0.01 | 7 | 5 | 2.0 | 0.71 | 0.29 | 0.4 |
| 6-9 | COMPARATIVE EXAMPLE | 0.34 | 0.22 | 0.76 | 0.023 | 0.017 | 0.030 | 0.15 | 0.01 | 8 | 1 | 4.4 | 0.13 | 0.55 | 4.4 |
| 6-10 | COMPARATIVE EXAMPLE | 0.50 | 0.23 | 0.87 | 0.022 | 0.014 | 0.015 | 0.10 | 0.01 | 8 | 6 | 1.3 | 0.5 | 0.16 | 0.3 |
| 6-11 | COMPARATIVE EXAMPLE | 0.44 | 0.18 | 0.70 | 0.025 | 0.019 | 0.016 | 0.05 | 0.00 | 9 | 2 | 0.0 | 0.22 | 0 | 0.0 |
| 6-12 | COMPARATIVE EXAMPLE | 0.33 | 0.19 | 0.69 | 0.020 | 0.010 | 0.023 | 0.04 | 0.01 | 12 | 14 | 0.0 | 1.17 | 0 | 0.0 |
| 6-13 | COMPARATIVE EXAMPLE | 0.26 | 0.20 | 0.46 | 0.021 | 0.009 | 0.002 | 0.04 | 0.01 | 9 | 1 | 0.0 | 0.11 | 0 | 0.0 |
| 7-1 | INVENTION EXAMPLE | 0.32 | 0.25 | 1.80 | 0.034 | 0.017 | 0.004 | 0.04 | 0.00 | 7 | 2 | 1.5 | 0.29 | 0.21 | 0.8 |
| 7-2 | COMPARATIVE EXAMPLE | 0.17 | 0.56 | 0.73 | 0.061 | 0.012 | 0.002 | 0.06 | 0.00 | 8 | 1 | 4.4 | 0.13 | 0.55 | 4.4 |
| 7-3 | INVENTION EXAMPLE | 0.16 | 0.52 | 0.75 | 0.070 | 0.015 | 0.001 | 0.05 | 0.00 | 6 | 1 | 4.0 | 0.17 | 0.57 | 4.0 |
| 7-4 | INVENTION EXAMPLE | 0.18 | 0.50 | 0.71 | 0.063 | 0.017 | 0.001 | 0.08 | 0.01 | 23 | 1 | 0.7 | 0.04 | 0.03 | 0.7 |
| 7-5 | COMPARATIVE EXAMPLE | 0.18 | 0.51 | 0.73 | 0.066 | 0.013 | 0.002 | 0.04 | 0.01 | 7 | 6 | 3.0 | 0.86 | 0.5 | 0.5 |

TABLE 2-2

| No. | | SLAG COMPOSITION IN SLAG (MASS %) CaO | $SiO_2$ | $Al_2O_3$ | T•Fe | AUXILIARY RAW MATERIAL CONDITIONS (INDICATING DIFFERENCE IN CA LEVEL) (1) ADDITION OF CaSi | (2) CA IN FeSi | REM ADDITION | RATIO IN INCLUSIONS (AVERAGE) (MASS %) $Al_2O_3$ | $REM_2O_3$ | EXTREME VALUE STATISTICS OF INCLUSIONS DETERMINATION | μM | NOTE |
|---|---|---|---|---|---|---|---|---|---|---|---|---|---|
| 1-1 | INVENTION EXAMPLE | 50.6 | 7.9 | 26.6 | 0.7 | NONE | 0.05 | ADDED | 67 | 20.8 | G | 18.8 | ※ BEARING STEEL (SUJ2) |
| 1-2 | INVENTION EXAMPLE | 51.0 | 6.6 | 26.6 | 0.9 | NONE | 0.05 | ADDED | 64.3 | 20.1 | G | 21.0 | |

TABLE 2-2-continued

| No. | | SLAG COMPOSITION IN SLAG ( MASS %) CaO | $SiO_2$ | $Al_2O_3$ | T•Fe | AUXILIARY RAW MATERIAL CONDITIONS (INDICATING DIFFERENCE IN CA LEVEL) (1) ADDITION OF CaSi | (2) CA IN FeSi | REM ADDITION | RATIO IN INCLUSIONS (AVERAGE) (MASS %) $Al_2O_3$ | $REM_2O_3$ | EXTREME VALUE STATISTICS OF INCLUSIONS DETER-MINATION | μM | NOTE |
|---|---|---|---|---|---|---|---|---|---|---|---|---|---|
| 1-3 | INVENTION EXAMPLE | 52.2 | 8.6 | 24.4 | 0.3 | NONE | 0.035 | ADDED | 64.7 | 19.5 | G | 20.2 | |
| 1-4 | INVENTION EXAMPLE | 51.3 | 8.8 | 25.4 | 0.4 | NONE | 0.042 | ADDED | 59.3 | 23. 1 | G | 24.0 | |
| 1-5 | COMPARATIVE EXAMPLE | 52.3 | 4.3 | 27.1 | 0.6 | NONE | 0.045 | NONE | 72.5 | 0 | B | 36.3 | |
| 1-6 | COMPARATIVE EXAMPLE | 49.8 | 9.1 | 26.8 | 0.3 | NONE | 0.038 | NONE | 78.9 | 0 | B | 31.3 | |
| 2-1 | INVENTION EXAMPLE | 43.7 | 16.1 | 28.2 | 0.9 | NONE | 0.039 | ADDED | 68.2 | 13.4 | G | 10.3 | ※ SUSPENSION SPRING A |
| 2-2 | COMPARATIVE EXAMPLE | 43.7 | 19.7 | 25.4 | 0.6 | NONE | 0.047 | NONE | 84.7 | 0 | B | 31.0 | |
| 2-3 | COMPARATIVE EXAMPLE | 48.4 | 13.7 | 25.0 | 0.3 | NONE | 0.28 | NONE | 79.2 | 0 | B | 34.2 | |
| 3-1 | COMPARATIVE EXAMPLE | 46.1 | 14.6 | 28.4 | 0.6 | NONE | 0.041 | NONE | 80.1 | 0 | B | 36.0 | ※ SUSPENSION SPRING B |
| 3-2 | COMPARATIVE EXAMPLE | 43.6 | 13.6 | 27.8 | 0.5 | NONE | 0.052 | NONE | 84.6 | 0 | B | 33.3 | |
| 3-3 | COMPARATIVE EXAMPLE | 43.5 | 12.9 | 27.9 | 0.8 | NONE | 0.031 | NONE | 81.3 | 0 | B | 30.5 | |
| 3-4 | COMPARATIVE EXAMPLE | 45.6 | 15.1 | 27.4 | 0.4 | NONE | 0.056 | NONE | 60.7 | 0 | VB | 39.0 | |
| 3-5 | COMPARATIVE EXAMPLE | 51.3 | 22.3 | 15.1 | 0.6 | NONE | 0.045 | NONE | 75.5 | 0 | B | 36.1 | |
| 3-6 | COMPARATIVE EXAMPLE | 47.3 | 16.0 | 23.4 | 0.7 | NONE | 0.039 | NONE | 85.6 | 0 | VB | 40.6 | |
| 3-7 | COMPARATIVE EXAMPLE | 42.9 | 15.5 | 25.6 | 0.7 | NONE | 0.03 | NONE | 45.1 | 0 | VB | 42.1 | |
| 4-1 | INVENTION EXAMPLE | 53.1 | 4.1 | 26.0 | 0.8 | NONE | 0.35 | ADDED | 55.7 | 7.1 | G | 22.0 | ※ CASE HARDENING STEEL |
| 4-2 | INVENTION EXAMPLE | 50.3 | 8.2 | 25.0 | 0.9 | NONE | 0.29 | ADDED | 51.8 | 10.5 | G | 27.0 | |
| 4-3 | INVENTION EXAMPLE | 46.3 | 9.8 | 28.0 | 0.6 | NONE | 0.32 | ADDED | 60.4 | 18.3 | G | 17.6 | |
| 4-4 | INVENTION EXAMPLE | 50.8 | 8.0 | 26.3 | 0.6 | NONE | 0.05 | ADDED | 58.2 | 20.6 | G | 24.8 | |
| 4-5 | COMPARATIVE EXAMPLE | 51.0 | 8.2 | 25.9 | 0.6 | NONE | 0.05 | ADDED | 56.1 | 35.7 | VB | 38.0 | |
| 4-6 | COMPARATIVE EXAMPLE | 50.3 | 8.2 | 25.0 | 0.4 | NONE | 0.33 | ADDED | 54.8 | 31.9 | VB | 47.0 | |
| 4-7 | COMPARATIVE EXAMPLE | 47.8 | 13.4 | 26.2 | 0.3 | NONE | 0.31 | NONE | 84.5 | 0 | VB | 49.0 | |
| 4-8 | COMPARATIVE EXAMPLE | 49.2 | 7.3 | 22.4 | 0.5 | NONE | 0.042 | ADDED | 82.8 | 5.9 | B | 33.0 | |
| 4-9 | COMPARATIVE EXAMPLE | 51.0 | 5.8 | 21.3 | 0.4 | USED | 0.038 | ADDED | 48.6 | 10.4 | VB | 38.0 | |
| 5-1 | INVENTION EXAMPLE | 48.8 | 2.0 | 35.0 | 1.2 | NONE | — | ADDED | 61.8 | 15.8 | G | 23.1 | ※ ALUMINIUM KILLED STEEL |
| 5-2 | INVENTION EXAMPLE | 54.8 | 3.1 | 26.4 | 0.7 | NONE | — | ADDED | 59.3 | 14.6 | G | 22.0 | |
| 5-3 | INVENTION EXAMPLE | 48.4 | 2.1 | 36.5 | 0.3 | NONE | — | ADDED | 58.7 | 22.4 | G | 24.0 | |
| 5-4 | COMPARATIVE EXAMPLE | 49.3 | 5.1 | 31.0 | 0.9 | NONE | — | NONE | 89.1 | 0 | VB | 51.0 | |
| 5-5 | COMPARATIVE EXAMPLE | 51.3 | 1.9 | 32.3 | 1.1 | NONE | — | NONE | 90 | 0 | VB | 41.0 | |
| 5-6 | COMPARATIVE EXAMPLE | 57.3 | 3.0 | 22.4 | 1.2 | NONE | — | NONE | 48.7 | 16.5 | B | 31.2 | |
| 6-1 | INVENTION EXAMPLE | 49.6 | 10.2 | 25.0 | 0.8 | NONE | 0.034 | ADDED | 67.3 | 18.7 | G | 22.9 | ※ SC STEEL |
| 6-2 | INVENTION EXAMPLE | 49.6 | 10.2 | 25.0 | 0.7 | NONE | 0.042 | ADDED | 75.2 | 9.4 | G | 22.0 | |
| 6-3 | INVENTION EXAMPLE | 55.9 | 7.5 | 21.5 | 0.9 | NONE | 0.76 | ADDED | 69.7 | 15.4 | G | 17.0 | |
| 6-4 | INVENTION EXAMPLE | 46.4 | 15.3 | 22.3 | 0.6 | NONE | 0.38 | ADDED | 71.5 | 12 | G | 18.2 | |

TABLE 2-2-continued

| No. | | SLAG COMPOSITION IN SLAG ( MASS %) CaO | $SiO_2$ | $Al_2O_3$ | T•Fe | AUXILIARY RAW MATERIAL CONDITIONS (INDICATING DIFFERENCE IN CA LEVEL) (1) ADDITION OF CaSi | (2) CA IN FeSi | REM ADDITION | RATIO IN INCLUSIONS (AVERAGE) (MASS %) $Al_2O_3$ | $REM_2O_3$ | EXTREME VALUE STATISTICS OF INCLUSIONS DETER-MINATION | μM | NOTE |
|---|---|---|---|---|---|---|---|---|---|---|---|---|---|
| 6-5 | INVENTION EXAMPLE | 48.2 | 10.2 | 26.1 | 0.7 | NONE | 0.042 | ADDED | 70 | 18.9 | G | 26.1 | |
| 6-6 | INVENTION EXAMPLE | 49.2 | 9.8 | 26.3 | 0.7 | NONE | 0.04 | ADDED | 73.4 | 10.7 | G | 21.0 | |
| 6-7 | COMPARATIVE EXAMPLE | 49.4 | 9.6 | 26.5 | 0.7 | NONE | 0.045 | ADDED | 61.9 | 22.2 | VB | 50.0 | |
| 6-8 | COMPARATIVE EXAMPLE | 49.9 | 9.1 | 26.0 | 0.6 | NONE | 0.04 | ADDED | 53.8 | 23.7 | VB | 43.0 | |
| 6-9 | COMPARATIVE EXAMPLE | 48.5 | 9.9 | 25.8 | 0.8 | NONE | 0.041 | ADDED | 57.6 | 27.1 | VB | 90.0 | |
| 6-10 | COMPARATIVE EXAMPLE | 46.2 | 7.6 | 29.1 | 0.5 | USED | 0.45 | ADDED | 47.8 | 19.4 | VB | 38.0 | |
| 6-11 | COMPARATIVE EXAMPLE | 47.5 | 7.9 | 30.2 | 0.7 | NONE | 0.87 | NONE | 54.8 | 0 | VB | 62.0 | |
| 6-12 | COMPARATIVE EXAMPLE | 48.6 | 8.1 | 26.8 | 0.9 | USED | 0.39 | NONE | 59.7 | 0 | VB | 40.0 | |
| 6-13 | COMPARATIVE EXAMPLE | 50.3 | 5.9 | 28.8 | 0.3 | NONE | 0.56 | NONE | 80.9 | 0 | B | 37.0 | |
| 7-1 | INVENTION EXAMPLE | 48.5 | 6.3 | 29.1 | 0.8 | NONE | 0.34 | ADDED | 60.8 | 8.4 | G | 15.8 | ※ OTHERS |
| 7-2 | COMPARATIVE EXAMPLE | 48.2 | 14.0 | 23.4 | 0.4 | NONE | 0.29 | ADDED | 72.5 | 10.2 | VB | 91.0 | |
| 7-3 | INVENTION EXAMPLE | 51.0 | 8.3 | 27.3 | 0.4 | NONE | 0.045 | ADDED | 52.1 | 45.3 | G | 29.4 | |
| 7-4 | INVENTION EXAMPLE | 49.2 | 6.9 | 30.8 | 0.4 | NONE | 0.034 | ADDED | 75.3 | 3.7 | G | 28.6 | |
| 7-5 | COMPARATIVE EXAMPLE | 50.2 | 7.6 | 28.9 | 0.4 | USED | 0.35 | ADDED | 40.1 | 25.6 | VB | 65.0 | |

In Table 2, the steel piece extreme value statistics of No. 1-1 are 18.8 μm (<30 μm). In No. 2-2, since REM is not added, the inclusions were not modified and the steel piece extreme value statistics were 31.0 μm. In No. 2-2, fatigue fracture occurs from the inclusions.

The steel piece extreme value statistics of the inclusions in the table were calculated using an extreme value statistical method in the following manner.

That is, the invention steel was cast by a curved continuous casting machine, and then in a steel piece rolled at a surface reduction ratio of 1.8 or greater, a steel sample was collected from a portion at a position of ¼ from the loose surface side of an L-cross-section of the steel piece (a cross-section including a center line of a loose surface, a center line of a surface opposite thereto, and a center line of the steel piece) and the steel piece extreme value statistics were calculated based on an extreme value statistical method including measurement under the conditions of an test standard area of 100 $mm^2$ (area of 10 mm×10 mm), a test field of 16 (that is, the number of tests is 16), and an area for performing prediction of 30,000 $mm^2$. The calculation was performed through the expression: urea (max)=$(a^2+b^2)^{1/2}$ where a is a major axis and b is a minor axis perpendicular to the major axis. Here, the loose surface is a surface on the upper surface side in a horizontal portion from a curved portion of the curved continuous casting machine.

The estimation of the maximum predicted diameter (√area (max)) of the inclusions using extreme value statistics is performed according to the method described in, for example, "Metal Fatigue, Effects of Micro-Defects and Inclusions" (written by Yukitaka Murakami, Yokendo, published in 1993, P. 223 to 239). The used method is a two-dimensional method of estimating maximum inclusions observed in a certain area by two-dimensional examination.

By using the above-described extreme value statistical method, the maximum predicted diameter √area (max) of the inclusions in the prediction area (30,000 $mm^2$) was estimated from the test standard area (100 $mm^2$) from the image of the nonmetallic inclusions imaged by an optical microscope. Specifically, 16 pieces of data (data of 16 fields) on maximum diameters of the inclusions obtained through the observation were plotted on extreme value probability paper in accordance with the method described in the document to obtain a maximum inclusion distribution straight line (linear function of the maximum inclusion and the extreme value statistical standardization variable), and the maximum inclusion distribution straight line was extrapolated to estimate a maximum predicted diameter √area (max) of the inclusions in the area of 30,000 $mm^2$.

In addition, for the specification of the nonmetallic inclusions, observation was performed at 1,000-fold magnification using an optical microscope to discriminate the nonmetallic inclusions from a difference in contrast. The validity of the discrimination method using the difference in contrast was previously confirmed by a scanning electron microscope with an energy dispersive X-ray spectroscopic analyzer. A plurality of inclusions was analyzed to obtain an average composition ratio of the inclusions.

Example 2

One of characteristics required for a steel to which the invention steel is applied is contact fatigue properties such as rolling fatigue properties and surface fatigue properties. Therefore, evaluation of radial rolling fatigue properties was performed in the following manner.

Cast steel pieces obtained from a plurality of molten steels based on components of steel type of SUJ2, in which Ca, REM, T.O, etc. were changed so as to have different maximum predicted diameters of inclusions, were held for 25 hours to 30 hours at 1200° C. to 1250° C. in a heating furnace, and cementite spheroidizing was performed. Then, blooming was performed at 1000° C. to 1200° C. The obtained steel pieces were heated at 900° C. to 1200° C. and rolled up to ϕ65 mm to provide a material of a radial rolling fatigue test piece.

Figure 7:
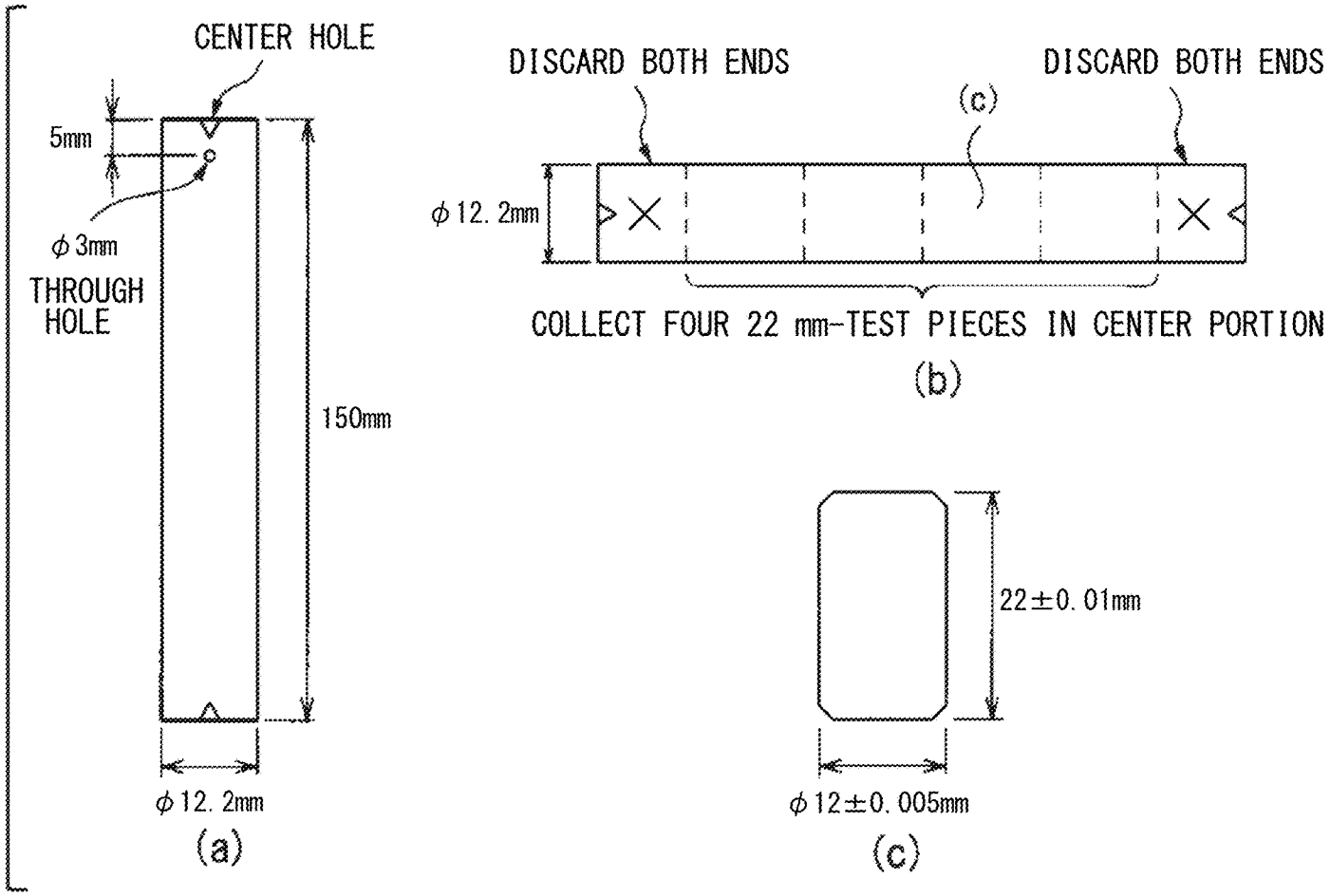
FIG. 7 shows an aspect of the production of a radial rolling fatigue test piece.

FIG. 7 shows an aspect of the production of the radial rolling fatigue test piece. FIG. 7(*a*) shows the shape of the material of the radial rolling fatigue test piece, FIG. 7(*b*) shows an aspect of the collection of the radial rolling fatigue test piece, and FIG. 7(*c*) shows a final shape of the collected radial rolling fatigue test piece.

Figure 8:
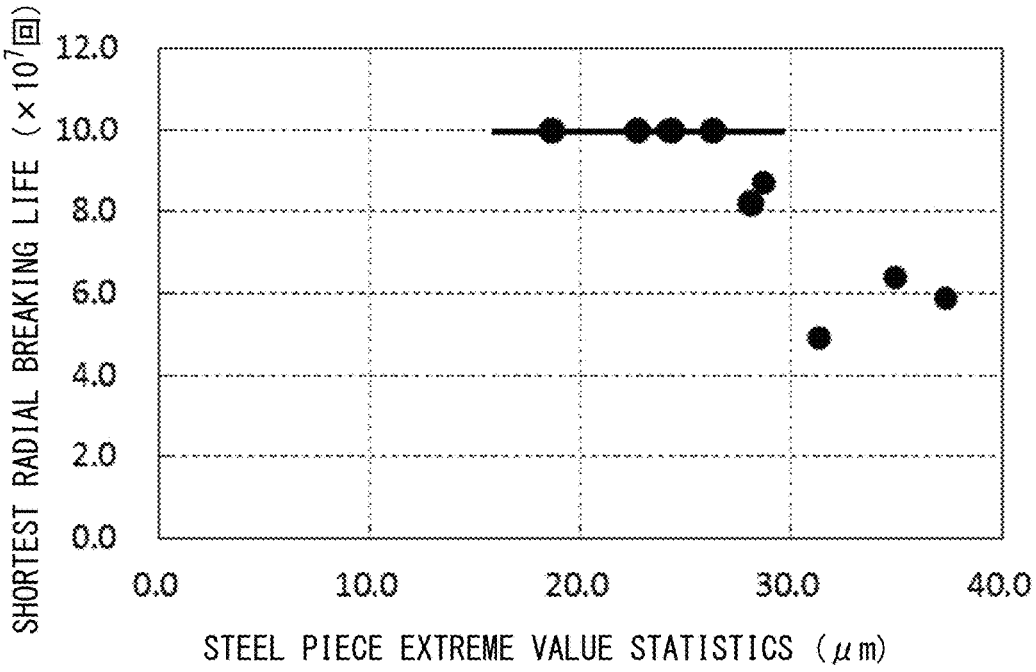
FIG. 8 is a diagram showing the relationship between steel piece extreme value statistics (maximum predicted diameter) obtained through an extreme value statistical method and the shortest breaking life obtained through a radial fatigue test.

FIG. 8 shows the relationship between the maximum predicted diameter (steel piece extreme value statistics) of each test piece, obtained through the extreme value statistical method, and the shortest breaking life obtained through the radial rolling fatigue test. $8\times10^7$ or greater of the shortest breaking life is obtained when the steel piece extreme value statistics are 30 μm or less.

Example 3

Figure 9:
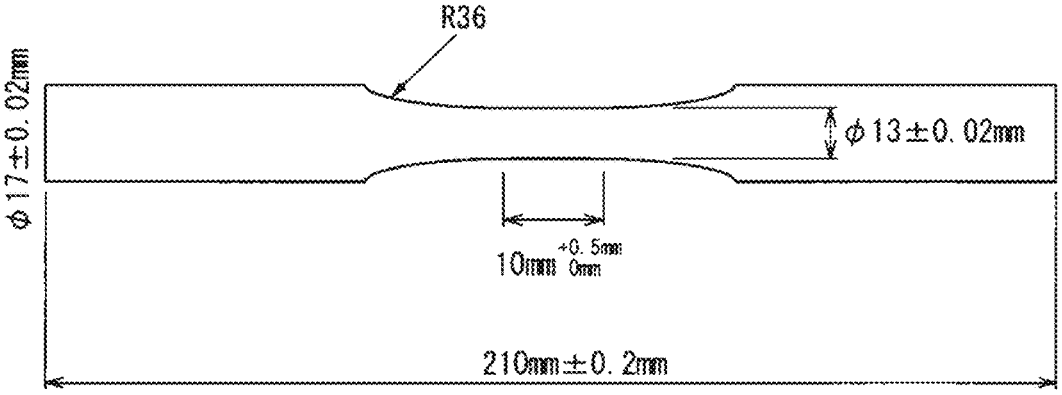
FIG. 9 is a diagram showing a shape of a test piece produced for evaluation of rotary bending fatigue properties.

Next, an Ono-type rotary bending test was performed to evaluate rotary bending fatigue properties. FIG. 9 shows a shape of a test piece produced for evaluation of the rotary bending fatigue properties.

Figure 10:
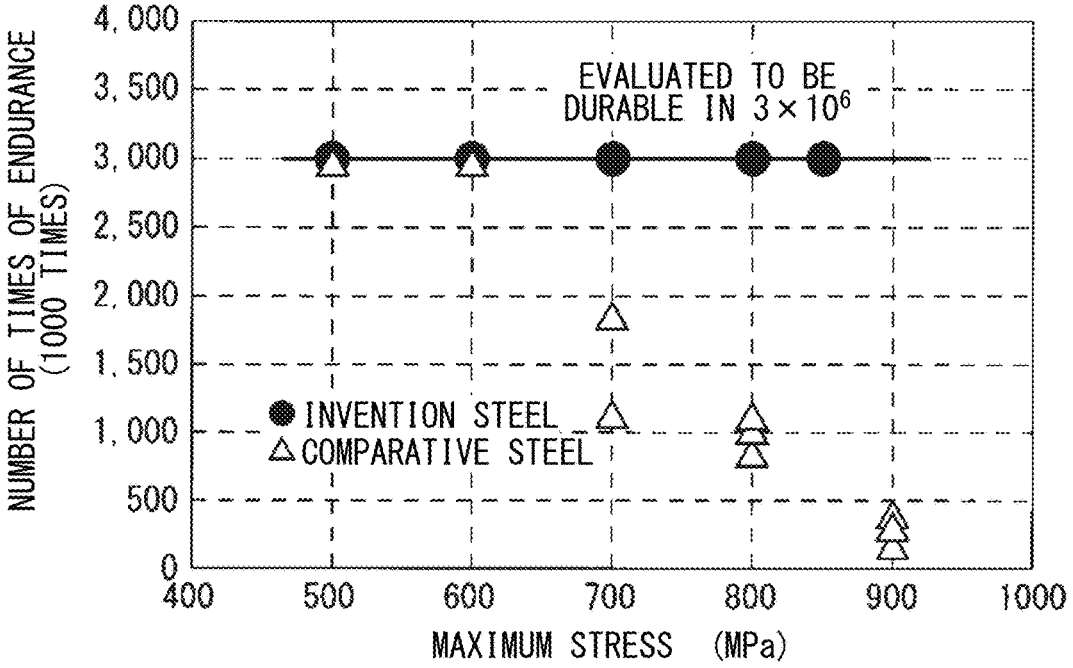
FIG. 10 is a diagram showing the relationship between maximum stress and the number of times of endurance, obtained through an Ono-type rotary bending test.

Using a test piece produced with dimensions shown in FIG. 9, the Ono-type rotary bending test was performed. The test piece was subjected to induction hardening (frequency: 100 kHz). Tap water or a polymer quenching catalyzer was used as a refrigerant in the induction hardening. After hardening, a tempering treatment was performed for 1 hr at 150° C. Table 3 shows the test results, and FIG. 10 shows the relationship between maximum stress and the number of times of endurance.

TABLE 3

| | | FATIGUE DURABILITY | | | | | |
|---|---|---|---|---|---|---|---|
| | | ONO-TYPE ROTARY BENDING FATIGUE TEST DURABLE IN $3\times10^6$ (STRESS: 600 MPa) | | ONO-TYPE ROTARY BENDING FATIGUE TEST DURABLE IN $3\times10^6$ (STRESS: 800 MPa) | | ONO-TYPE ROTARY BENDING FATIGUE TEST DURABLE IN $3\times10^6$ (STRESS 900 MPa) | |
| No. | CLASSIFICATION | EVALUATION | FRACTURE STARTING POINT | EVALUATION | FRACTURE STARTING POINT | EVALUATION | FRACTURE STARTING POINT |
| 2-1 | INVENTION STEEL | DURABLE | — | DURABLE | — | BREAKAGE DURING TEST | SURFACE |
| | INVENTION STEEL | DURABLE | — | DURABLE | — | BREAKAGE DURING TEST | SURFACE |
| | INVENTION STEEL | DURABLE | — | DURABLE | — | BREAKAGE DURING TEST | SURFACE |
| 2-2 | COMPARATIVE STEEL | DURABLE | — | BREAKAGE DURING TEST | INCLUSIONS | BREAKAGE DURING TEST | INCLUSIONS |
| | COMPARATIVE STEEL | DURABLE | — | BREAKAGE DURING TEST | INCLUSIONS | BREAKAGE DURING TEST | INCLUSIONS |
| | COMPARATIVE STEEL | DURABLE | — | BREAKAGE DURING TEST | INCLUSIONS | BREAKAGE DURING TEST | INCLUSIONS |

From the material of the radial rolling fatigue test piece (hereinafter, referred to as "test piece") of ϕ65 mm, a round bar (having a center hole at both ends and a through hole of ϕ 3 mm in one end portion at a position separate from the end surface by 5 mm) having the shape (ϕ: 12.2 mm, length: 150 mm) shown in FIG. 7(*a*) was produced.

This round bar was heated for 30 minutes at 840° C. in an induction heating furnace, and then subjected to quench with oil at 50° C. Thereafter, it was annealed for 90 minutes at 180° C. and air-cooled. From the round bar after the heat treatment, both ends of the round bar were discarded as shown in FIG. 7(*b*), and four 22 mm-test pieces having the final shape shown in FIG. 7(*c*) were collected from a center portion thereof and provided to the radial rolling fatigue test.

The radial rolling fatigue test was performed on 12 test pieces under the conditions of a test load of 600 kgf, a repetition rate of 46240 cpm, and the number of times of stopping of $1\times10^8$ using a radial rolling fatigue test machine (product name: "cylindrical fatigue life test machine" manufactured by NTN Corporation).

From Table 3 and FIG. 3, it is found that the invention steel has much better rotary bending fatigue properties than the comparative steel.

As described above, the invention steel has much better fatigue properties than the conventional steel. Therefore, it is apparent that the life of a steel product produced from the invention steel increases significantly.

The improvement in mechanical characteristics of the invention steel was verified while paying attention to fatigue properties having a large influence on inclusions and a decrease in size of nonmetallic inclusion was confirmed in all of the target steels. Accordingly, in the invention steel, in addition to the fatigue properties, mechanical characteristics (toughness, ductility, etc.) necessary for casting, pressing, and other processings are also presumed to be improved.

INDUSTRIAL APPLICABILITY

As described above, according to the invention, high-melting-point $Al_2O_3$-REM oxide which has CaO—$Al_2O_3$- based inclusions modified by adding a minute amount of REM to Al-deoxidized molten steel or Al—Si-deoxidized molten steel and hardly aggregates, and fine nonmetallic inclusions containing REM sulfide, MgO, or both of REM sulfide and MgO exist in the steel. Accordingly, steel having excellent fatigue properties can be provided and an improvement in other mechanical characteristics can also be expected. As a result, since the life of a steel product produced from the steel of the invention increases significantly, the invention is highly applicable in steel production industries and in steel working industries.

The invention claimed is:

1. A low-oxygen clean steel containing C, Si, Mn, P, and S as chemical components, and further containing, by mass %, 0.010% to 0.20% of Al, 0.0001% to 0.0003% of Ca, 0.00005% to 0.0004% of REM, and greater than 0% to 0.003% of T.O, wherein the REM content, the Ca content, and the T.O content satisfy the following Expressions 1 and 2, nonmetallic inclusions which have a maximum predicted diameter of 1 μm to 30 μm measured using an extreme value statistical method under the condition in which a prediction area is 30,000 $mm^2$, and contain $Al_2O_3$ and REM oxide are dispersed in the steel, a proportion of the $Al_2O_3$ is greater than 50% by mass based on the total amount of nonmetallic inclusions, a proportion of CaO is 1.0% or less by mass based on the total amount of the nonmetallic inclusions, the REM is one or two or more of rare-earth elements La, Ce, Pr, and Nd, and the steel is Al-deoxidized steel or Al—Si-deoxidized steel, $$0.15 \leq REM/Ca \leq 4.00 \quad \text{Expression 1,}$$

$$Ca/T.O \leq 0.50 \quad \text{Expression 2.}$$

2. The low-oxygen clean steel according to claim 1, wherein the following Expression 3 is satisfied, $$0.05 \leq REM/T.O \leq 0.50 \quad \text{Expression 3.}$$

3. The low-oxygen clean steel according to claim 1, containing, by mass %, 1.20% or less of C, 3.00% or less of Si, 16.0% or less of Mn, 0.05% or less of P, and 0.05% or less of S as the chemical components with the remainder Fe and impurities.

4. The low-oxygen clean steel according to claim 3, further containing, by mass %, one or two or more of 3.50% or less of Cr, 0.85% or less of Mo, 4.50% or less of Ni, 0.20% or less of Nb, 0.45% or less of V, 0.30% or less of W, 0.006% or less of B, 0.06% or less of N, 0.25% or less of Ti, 0.50% or less of Cu, 0.45% or less of Pb, 0.20% or less of Bi, 0.01% or less of Te, 0.20% or less of Sb, and 0.01% or less of Mg as the chemical components.

5. A low-oxygen clean steel product produced by processing the low-oxygen clean steel according to claim 1.

6. A low-oxygen clean steel product produced by processing the low-oxygen clean steel according to claim 3.

7. A low-oxygen clean steel product produced by processing the low-oxygen clean steel according to claim 4.

8. The low-oxygen clean steel according to claim 2, containing, by mass %, 1.20% or less of C, 3.00% or less of Si, 16.0% or less of Mn, 0.05% or less of P, and 0.05% or less of S as the chemical components with the remainder Fe and impurities.

9. The low-oxygen clean steel according to claim 8, further containing, by mass %, one or two or more of 3.50% or less of Cr, 0.85% or less of Mo, 4.50% or less of Ni, 0.20% or less of Nb, 0.45% or less of V, 0.30% or less of W, 0.006% or less of B, 0.06% or less of N, 0.25% or less of Ti, 0.50% or less of Cu, 0.45% or less of Pb, 0.20% or less of Bi, 0.01% or less of Te, 0.20% or less of Sb, and 0.01% or less of Mg as the chemical components.

10. A low-oxygen clean steel product produced by processing the low-oxygen clean steel according to claim 2.

11. A low-oxygen clean steel product produced by processing the low-oxygen clean steel according to claim 8.

12. The low-oxygen clean steel according to claim 1, wherein a proportion of $SiO_2$ in the inclusions is 1.0% or less by mass based on the total amount of nonmetallic inclusions.

13. The low-oxygen clean steel according to claim 1, wherein the proportion of the $Al_2O_3$ in the inclusions is greater than 61.8% to 82.9% by mass based on the total amount of the nonmetallic inclusions.

14. The low-oxygen clean steel according to claim 1, wherein the proportion of the $Al_2O_3$ is greater than 66.0% to 82.9% by mass based on the total amount of nonmetallic inclusions.

* * * * *